US012055027B2

(12) United States Patent
Zheng

(10) Patent No.: US 12,055,027 B2
(45) Date of Patent: Aug. 6, 2024

(54) AUTOMATING WELL CONSTRUCTION OPERATIONS BASED ON DETECTED ABNORMAL EVENTS

(71) Applicant: Schlumberger Technology Corporation, Sugar Land, TX (US)

(72) Inventor: Shunfeng Zheng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 702 days.

(21) Appl. No.: 16/811,770

(22) Filed: Mar. 6, 2020

(65) Prior Publication Data

US 2021/0277763 A1 Sep. 9, 2021

(51) Int. Cl.

| | |
|---|---|
| ***E21B 44/00*** | (2006.01) |
| ***E21B 44/02*** | (2006.01) |
| ***E21B 44/10*** | (2006.01) |
| ***E21B 47/26*** | (2012.01) |

(52) U.S. Cl.

CPC ..... *E21B 44/005* (2013.01); *E21B 44/02* (2013.01); *E21B 44/10* (2013.01); *E21B 47/26* (2020.05)

(58) Field of Classification Search

CPC ..... E21B 44/00; E21B 44/005; E21B 44/02; E21B 44/10; E21B 47/26; E21B 21/08

See application file for complete search history.

(56) References Cited

U.S. PATENT DOCUMENTS

| | | | |
|---|---|---|---|
| 5,713,422 | A | 2/1998 | Dhindsa |
| 6,484,816 | B1 | 11/2002 | Koederitz |
| 6,892,812 | B2 | 5/2005 | Niedermayr et al. |
| 6,896,055 | B2 | 5/2005 | Koithan |
| 6,931,621 | B2 | 8/2005 | Green et al. |
| 7,172,037 | B2 | 2/2007 | Dashevskiy et al. |

(Continued)

FOREIGN PATENT DOCUMENTS

| | | | |
|---|---|---|---|
| WO | 2017116474 | A1 | 7/2017 |
| WO | 2017132297 | A2 | 8/2017 |

(Continued)

OTHER PUBLICATIONS

International Search Report and Written Opinion issued Jun. 23, 2021 for the equivalent PCTUS21021323 15 pages.

(Continued)

*Primary Examiner* — Christopher J Sebesta
*Assistant Examiner* — Yanick A Akaragwe
(74) *Attorney, Agent, or Firm* — Aashish Y. Chawla

(57) ABSTRACT

Apparatus and methods for automating well construction operations based on detected abnormal events. A method may comprise commencing operation of an equipment controller of a control system for monitoring and controlling a well construction system. The well construction system may comprise well construction equipment operable to perform well construction operations. Commencing operation of the equipment controller may cause the equipment controller to receive sensor data from a sensor, detect an abnormal downhole event based on the sensor data, select an operational sequence to be performed by the well construction equipment based on the abnormal downhole event, and output control data to cause the well construction equipment to perform the operational sequence thereby mitigating the abnormal downhole event.

18 Claims, 5 Drawing Sheets

(56) References Cited

U.S. PATENT DOCUMENTS 7,264,050 B2 9/2007 Koithan et al.
7,357,196 B2 4/2008 Goldman et al.
7,860,593 B2 12/2010 Boone
7,895,220 B2 2/2011 Evans et al.
7,938,197 B2 5/2011 Boone et al.
7,945,488 B2 5/2011 Karr et al.
8,103,493 B2 1/2012 Sagert et al.
8,121,971 B2 2/2012 Edwards et al.
8,131,510 B2 3/2012 Wingky et al.
8,145,464 B2 3/2012 Arnegaard et al.
8,215,417 B2 7/2012 Annaiyappa et al.
8,250,816 B2 8/2012 Donnally et al.
8,301,386 B1 10/2012 Redmond et al.
8,386,059 B2 2/2013 Boone
8,590,635 B2 11/2013 Koederitz
8,718,802 B2 5/2014 Boone
8,794,353 B2 * 8/2014 Benson ..... E21B 47/047 175/45
9,027,671 B2 5/2015 Koederitz
9,223,594 B2 12/2015 Brown et al.
9,285,794 B2 3/2016 Wang et al.
9,322,247 B2 4/2016 Rojas et al.
9,410,417 B2 8/2016 Reckmann et al.
9,429,009 B2 8/2016 Paulk et al.
9,436,173 B2 9/2016 Wang et al.
9,506,336 B2 11/2016 Orbell
9,528,364 B2 12/2016 Samuel et al.
9,593,567 B2 3/2017 Pink et al.
9,598,947 B2 3/2017 Wang et al.
9,784,089 B2 10/2017 Boone et al.
9,803,473 B2 10/2017 Orban et al.
9,828,845 B2 11/2017 Kpetehoto et al.
9,896,925 B2 2/2018 Hernandez et al.
9,946,445 B2 4/2018 Whalley
9,995,129 B2 6/2018 Dykstra et al.
10,067,973 B2 9/2018 Moore
10,113,408 B2 10/2018 Pobedinski et al.
10,138,722 B2 11/2018 Magnuson
10,198,159 B2 2/2019 Ziegler et al.
10,202,837 B2 2/2019 Ng et al.
10,221,671 B1 3/2019 Zhang
10,233,728 B2 3/2019 Kristjansson et al.
10,253,612 B2 4/2019 Dashevskiy et al.
10,273,752 B2 4/2019 Mebane, III
10,323,496 B2 6/2019 Abbassian et al.
10,345,771 B2 7/2019 Anno et al.
10,353,358 B2 7/2019 Tunc et al.
10,370,902 B2 8/2019 Hadi
10,370,911 B2 8/2019 Curry et al.
10,378,318 B2 8/2019 Gleitman et al.
10,378,329 B2 8/2019 Boone
10,400,572 B2 9/2019 Lovorn et al.
10,415,362 B1 9/2019 Basu et al.
10,415,364 B2 9/2019 Kyllingstad
10,415,366 B2 9/2019 Boone
10,422,188 B2 9/2019 Zheng et al.
10,422,912 B2 9/2019 Holtz
10,428,637 B2 10/2019 Abbassian et al.
10,428,638 B2 10/2019 Miller
10,443,325 B2 10/2019 Zheng et al.
10,443,329 B2 10/2019 Savage et al.
10,458,223 B2 10/2019 Badkoubeh et al.
10,487,641 B2 11/2019 Zheng et al.
10,493,383 B2 12/2019 Teodorescu
10,508,530 B2 12/2019 Gillan
10,539,001 B2 1/2020 Kpetehoto et al.
10,550,640 B2 2/2020 Orban et al.
10,550,642 B2 2/2020 Zheng et al.
10,570,677 B2 2/2020 Richardson et al.
10,570,698 B2 2/2020 Peyregne et al.
10,577,914 B2 3/2020 Astrid et al.
10,577,929 B2 3/2020 Price et al.
10,591,625 B2 3/2020 Holt et al.
10,612,359 B2 4/2020 Zheng et al.
10,662,751 B2 5/2020 Payette et al.
10,669,834 B2 6/2020 Dykstra et al.
2011/0024189 A1 * 2/2011 Saeed ..... E21B 44/00 175/40
2011/0042076 A1 * 2/2011 Reitsma ..... E21B 21/08 166/250.01
2013/0256033 A1 10/2013 Gleitman
2014/0020953 A1 * 1/2014 Chau ..... E21B 47/024 175/48
2014/0105755 A1 * 4/2014 Bookout ..... E21B 43/128 417/15
2014/0124218 A1 5/2014 Pilgrim
2014/0151121 A1 6/2014 Boone et al.
2015/0053483 A1 * 2/2015 Mebane, III ..... E21B 47/12 175/26
2015/0241871 A1 8/2015 Yoshino et al.
2015/0369030 A1 12/2015 Hay et al.
2016/0054729 A1 2/2016 Payette et al.
2016/0222775 A1 8/2016 Tunc et al.
2016/0290073 A1 10/2016 Zheng et al.
2016/0291201 A1 10/2016 Tunc et al.
2016/0369619 A1 12/2016 Parmeshwar et al.
2017/0122092 A1 5/2017 Harmer
2017/0159372 A1 6/2017 Zheng et al.
2017/0167853 A1 6/2017 Zheng et al.
2017/0308802 A1 10/2017 Ramsoy et al.
2018/0149010 A1 5/2018 Zheng et al.
2018/0152319 A1 5/2018 Rojas et al.
2018/0156023 A1 6/2018 Dykstra et al.
2018/0171760 A1 6/2018 Zheng et al.
2018/0187498 A1 * 7/2018 Sanchez Soto ..... E21B 47/06
2018/0274323 A1 9/2018 Arefi et al.
2018/0283137 A1 10/2018 Peyregne et al.
2018/0298693 A1 10/2018 Van Duivendijk et al.
2018/0298694 A1 10/2018 Van Duivendijk et al.
2018/0328159 A1 11/2018 Mandava et al.
2018/0334887 A1 11/2018 Dashevskiy et al.
2018/0347281 A1 * 12/2018 Duplantis ..... E21B 44/00
2018/0351952 A1 12/2018 Rojas et al.
2018/0355700 A1 12/2018 Zheng et al.
2018/0359130 A1 12/2018 Zheng et al.
2018/0359339 A1 12/2018 Zheng et al.
2019/0018871 A1 1/2019 Zheng et al.
2019/0032466 A1 1/2019 Wilson et al.
2019/0048703 A1 2/2019 Samuel et al.
2019/0048704 A1 2/2019 Kumaran
2019/0078045 A1 3/2019 Khan
2019/0078425 A1 3/2019 Gillan
2019/0078426 A1 3/2019 Zheng et al.
2019/0078427 A1 3/2019 Gillan
2019/0078428 A1 3/2019 Fang et al.
2019/0094840 A1 3/2019 Zheng et al.
2019/0106978 A1 4/2019 Etaje et al.
2019/0106982 A1 4/2019 Willerth et al.
2019/0122151 A1 4/2019 Hildebrand et al.
2019/0128079 A1 5/2019 Omrani
2019/0136650 A1 5/2019 Zheng et al.
2019/0146118 A1 5/2019 Bermudez Martinez et al.
2019/0153848 A1 5/2019 Ng et al.
2019/0234202 A1 8/2019 Orban et al.
2020/0003046 A1 1/2020 Zheng et al.
2020/0040720 A1 2/2020 Zalluhoglu et al.
2020/0056470 A1 2/2020 Ng et al.
2020/0056478 A1 2/2020 Lima
2020/0080410 A1 3/2020 Kjosmoen
2021/0040834 A1 * 2/2021 Valleru ..... G06F 9/542
2021/0301642 A1 * 9/2021 Wicks ..... E21B 3/022

FOREIGN PATENT DOCUMENTS

WO 2017142540 A1 8/2017
WO 2017160993 A1 9/2017
WO 2017187368 A1 11/2017
WO 2017204655 A1 11/2017
WO 2018186745 A1 10/2018
WO 2018213126 A1 11/2018
WO 2019035848 A1 2/2019
WO 2019066932 A1 4/2019
WO 2019173842 A1 9/2019

(56) References Cited

FOREIGN PATENT DOCUMENTS

| | | | |
|---|---|---|---|
| WO | 2020005850 | A1 | 1/2020 |
| WO | 2020014009 | A1 | 1/2020 |
| WO | 2020018121 | A1 | 1/2020 |
| WO | 2020027846 | A1 | 2/2020 |

OTHER PUBLICATIONS

Wilson et al., "High-Frequency At-Bit Measurements Provide New Insights Into Torsional Dynamics When Drilling With Steerable Mud Motors in Unconventional Horizontal Wells", SPE 194072, Dec. 2019 SPE Drilling & Completion, pp. 414-425.

* cited by examiner

AUTOMATING WELL CONSTRUCTION OPERATIONS BASED ON DETECTED ABNORMAL EVENTS

BACKGROUND OF THE DISCLOSURE

Wells are generally drilled into the ground or ocean bed to recover natural deposits of oil, gas, and other materials that are trapped in subterranean formations. Well construction operations (e.g., drilling operations) may be performed at a wellsite by a well construction system (e.g., drilling rig) having various surface and subterranean well construction equipment being operated in a coordinated manner. For example, a drive mechanism, such as a top drive located at a wellsite surface, can be utilized to rotate and advance a drill string into a subterranean formation to drill a wellbore. The drill string may include a plurality of drill pipes coupled together and terminating with a drill bit. Length of the drill string may be increased by adding additional drill pipes while depth of the wellbore increases.

The well construction equipment may be grouped into various subsystems, wherein each subsystem performs a different operation controlled by a corresponding local controller. Each local controller is typically implemented as a standalone controller operable to execute processes associated with the corresponding subsystem. Although the well construction equipment may operate in a coordinated manner, there is little or no communication between the subsystems and their controllers, whereby coordination and/or interactions between the subsystems are typically initiated, monitored, and controlled by rig personnel (i.e., human equipment operators).

The well construction equipment is typically monitored and controlled from a control center of the well construction system. A typical control center houses a control workstation operable to receive sensor data from various sensors associated with the well construction equipment and permit monitoring of the well construction equipment. The control workstation may facilitate manual control of the well construction equipment by rig personnel (e.g., a driller). However, relying on rig personnel to manually coordinate the well construction operations, monitor the well construction operations for abnormal conditions and events, and control the well construction equipment in response to such abnormal conditions and events limits speed, efficiency, and safety of the well construction operations.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a control system of a well construction system. The well construction system includes well construction equipment operable to perform well construction operations. The control system includes a sensor and an equipment controller. The sensor outputs sensor data. The equipment controller is communicatively connected with the sensor and the well construction equipment. The equipment controller includes a processing device and a memory storing an executable program code. During the well construction operations, the equipment controller is operable to receive the sensor data, detect an abnormal downhole event based on the sensor data, select an operational sequence to be performed by the well construction equipment based on the abnormal downhole event, and output control data to cause the well construction equipment to perform the selected operational sequence, thereby mitigating the abnormal downhole event.

The present disclosure also introduces a method including commencing operation of an equipment controller of a control system for monitoring and controlling a well construction system. The well construction system includes well construction equipment operable to perform well construction operations. Commencing operation of the equipment controller causes the equipment controller to receive sensor data from a sensor, detect an abnormal downhole event based on the sensor data, select an operational sequence to be performed by the well construction equipment based on the abnormal downhole event, and output control data to cause the well construction equipment to perform the operational sequence, thereby mitigating the abnormal downhole event.

The present disclosure also introduces a method including commencing operation of an equipment controller of a control system for monitoring and controlling a well construction system. The well construction system includes well construction equipment operable to perform well construction operations. Commencing operation of the equipment controller causes the equipment controller to receive a well construction plan, receive sensor data from a sensor, select a planned operational sequence to be performed by the well construction equipment based on the well construction plan, output control data to cause the well construction equipment to perform the planned operational sequence, and detect an abnormal downhole event based on the sensor data. Commencing operation of the equipment controller also causes the equipment controller to, after detecting the abnormal downhole event, select a mitigating operational sequence to be performed by the well construction equipment based on the abnormal downhole event, output control data to cause the well construction equipment to stop performing the planned operational sequence, and output control data to cause the well construction equipment to perform the mitigating operational sequence, thereby mitigating the abnormal downhole event.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the following disclosure describes many example implementations for different aspects introduced herein. Specific examples of components and arrangements are described below to simplify the present disclosure. These are merely examples, and are not intended to be limiting. In addition, the present disclosure may repeat reference numbers and/or letters in the various examples. This repetition is for simplicity and clarity, and does not in itself dictate a relationship between the various implementations described herein. Moreover, the formation of a first feature over or on a second feature in the description that follows may include implementations in which the first and second features are formed in direct contact, and may also include implementations in which additional features may be formed interposing the first and second features, such that the first and second features may not be in direct contact.

Systems and methods (e.g., processes, operations) according to one or more aspects of the present disclosure may be utilized or otherwise implemented in association with an automated well construction system (i.e., well construction rig) at an oil and gas wellsite, such as for constructing a wellbore for extracting hydrocarbons (e.g., oil and/or gas) from a subterranean formation. However, one or more aspects of the present disclosure may be utilized or otherwise implemented in association with other automated systems in the oil and gas industry and other industries. For example, one or more aspects of the present disclosure may be implemented in association with wellsite systems for performing fracturing, cementing, acidizing, chemical injecting, and/or water jet cutting operations, among other examples. One or more aspects of the present disclosure may also be implemented in association with mining sites, building construction sites, and/or other work sites where automated machines or equipment are utilized.

Figure 1:
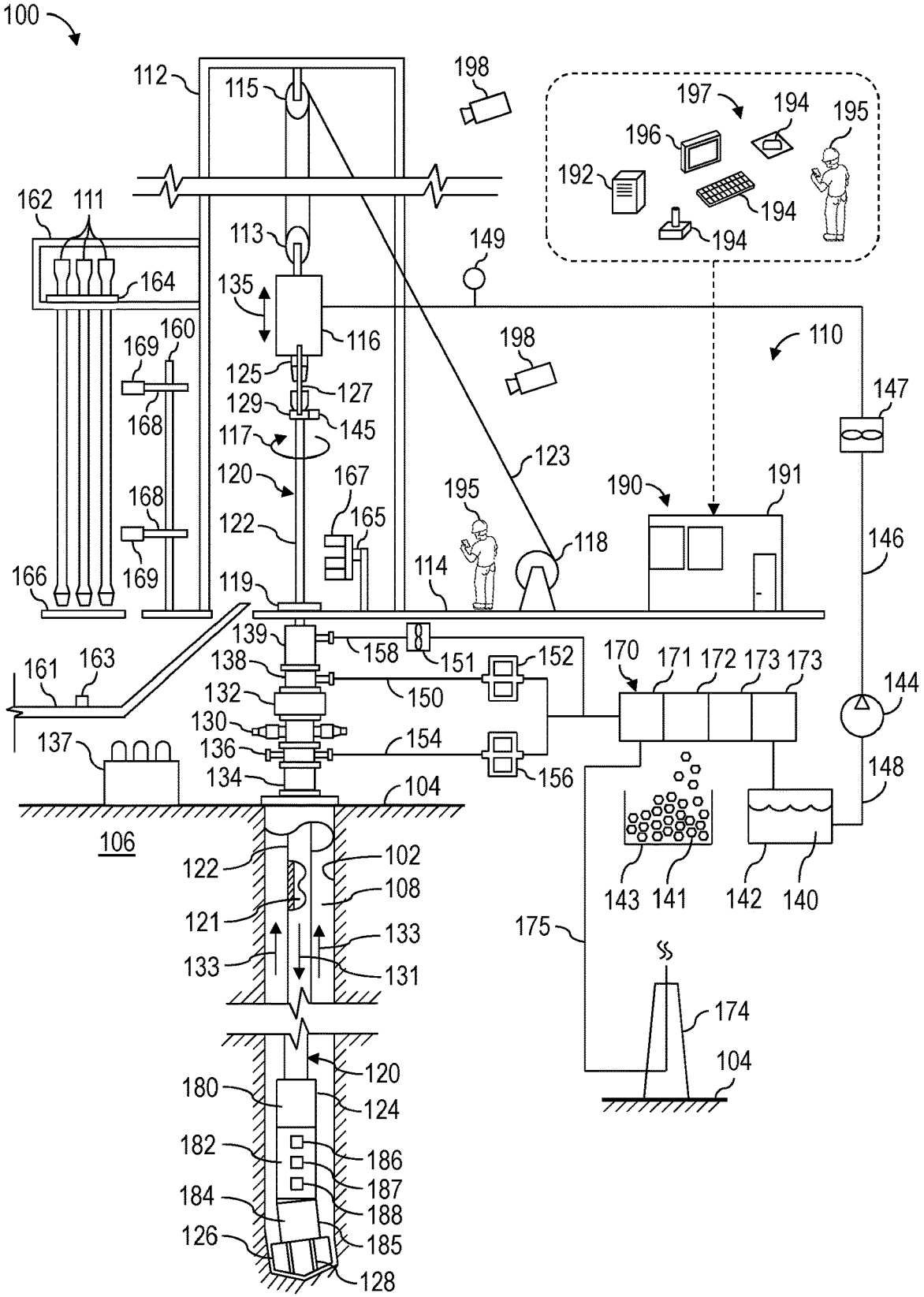
FIG. 1 is a schematic side view of at least a portion of an example implementation of apparatus according to one or more aspects of the present disclosure.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction (e.g., drilling) rig. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 comprises various well construction equipment (i.e., wellsite equipment), including surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown).

The drill string 120 may comprise a bottom-hole assembly (BHA) 124 and means 122 for conveying the BHA 124 within the wellbore 102. The conveyance means 122 may comprise a plurality of interconnected tubulars, such as drill pipe, heavy-weight drill pipe (HWDP), wired drill pipe (WDP), tough logging condition (TLC) pipe, and drill collars, among other examples. The conveyance means 122 may instead comprise coiled tubing for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated from the wellsite surface 104 and/or via a downhole mud motor 184 connected with the drill bit 126. The BHA 124 may also include various downhole devices and/or tools 180, 182. The mud motor 184 may comprise a mud motor toolface 185 (also known in the industry as a BHA toolface) aligned with the direction of a bent sub of the BHA 124 and the drill bit 126.

One or more of the downhole tools 180, 182 may be or comprise an MWD or LWD tool comprising one or more sensors 186 operable for the acquisition of measurement and/or logging data pertaining to the BHA 124, the wellbore 102, and/or the formation 106. The sensors 186 may include one or more of a pressure sensor, an axial load sensor (i.e., a weight sensor), a fluid flow rate sensor, a position sensor, a speed sensor, an acceleration sensor, an orientation sensor, and a torque sensor, among other examples. One or more of the downhole tools 180, 182 and/or another portion of the BHA 124 may also comprise a telemetry device 187 operable for communication with the surface equipment 110, such as via mud-pulse telemetry. One or more of the downhole tools 180, 182 and/or another portion of the BHA 124 may also comprise a downhole controller 188 (e.g., a processing device) operable to receive, process, and/or store information received from the surface equipment 110, the sensors 186, and/or other portions of the BHA 124. The downhole controller 188 may also store executable computer programs (e.g., program code instructions), including for implementing one or more aspects of the operations described herein.

The support structure 112 may support a driver, such as a top drive 116, operable to connect (perhaps indirectly) with an upper end of the drill string 120, and to impart rotary motion 117 and vertical motion 135 to the drill string 120, including the drill bit 126. However, another driver, such as a kelly and rotary table (neither shown), may be utilized instead of or in addition to the top drive 116 to impart the rotary motion 117 to the drill string 120. The top drive 116 and the connected drill string 120 may be suspended from the support structure 112 via a hoisting system or equipment, which may include a traveling block 113, a crown block 115, and a drawworks 118 storing a support cable or line 123. The crown block 115 may be connected to or otherwise supported by the support structure 112, and the traveling block 113 may be coupled with the top drive 116. The drawworks 118 may be mounted on or otherwise supported by the rig floor 114. The crown block 115 and traveling block 113 comprise pulleys or sheaves around which the support line 123 is reeved to operatively connect the crown block 115, the traveling block 113, and the drawworks 118 (and perhaps an anchor). The drawworks 118 may thus selectively impart tension to the support line 123 to lift and lower the top drive 116, resulting in the vertical motion 135. The drawworks 118 may comprise a drum, a base, and a prime mover (e.g., an engine or motor) (not shown) operable to drive the drum to rotate and reel in the support line 123, causing the traveling block 113 and the top drive 116 to move upward. The drawworks 118 may be operable to reel out the support line 123 via a controlled rotation of the drum, causing the traveling block 113 and the top drive 116 to move downward.

The top drive 116 may comprise a grabber, a swivel (neither shown), elevator links 127 terminating with an elevator 129, and a drive shaft 125 operatively connected with a prime mover (not shown), such as via a gear box or transmission (not shown). The drive shaft 125 may be selectively coupled with the upper end of the drill string 120 and the prime mover may be selectively operated to rotate the drive shaft 125 and the drill string 120 coupled with the drive shaft 125. Hence, during drilling operations, the top drive 116, in conjunction with operation of the drawworks 118, may advance the drill string 120 into the formation 106 to form the wellbore 102. The elevator links 127 and the elevator 129 of the top drive 116 may handle tubulars (e.g., drill pipes, drill collars, casing joints, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The grabber may include a clamp that clamps onto a tubular when making up and/or breaking out a connection of a tubular with the drive shaft 125. The top drive 116 may have a guide system (not shown), such as rollers that track up and down a guide rail on the support structure 112. The guide system may aid in keeping the top drive 116 aligned with the wellbore 102, and in preventing the top drive 116 from rotating during drilling by transferring reactive torque to the support structure 112.

The hoisting system may further comprise a weight sensor 145 operable to output sensor data (e.g., signals, measurements) indicative of weight of the drill string 120. The weight sensor 145 may be disposed or installed in association with the top drive links (not shown), the elevator links 127, the elevator 129, a deadline anchor (not shown), and/or other portions of the hoisting system. Each weight sensor 145 may be or comprise a load sensor (e.g., a load cell, a strain gauge, etc.) operable to output sensor data indicative of weight of the drill string 120. The weight measurement of the drill string 120 may be or comprise the hook load of the hoisting system determined based on the sensor data output by the weight sensor 145.

The drill string 120 may be conveyed within the wellbore 102 through various fluid control devices disposed at the wellsite surface 104 on top of the wellbore 102 and perhaps below the rig floor 114. The fluid control devices may be operable to control fluid within the wellbore 102. The fluid control devices may include a blowout preventer (BOP) stack 130 for maintaining well pressure control comprising a series of pressure barriers (e.g., rams) between the wellbore 102 and an annular preventer 132. The fluid control devices may also include a rotating control device (RCD) 138 mounted above the annular preventer 132. The fluid control devices 130, 132, 138 may be mounted on top of a wellhead 134. A power unit 137 (i.e., a BOP control or closing unit) may be operatively connected with one or more of the fluid control devices 130, 132, 138 and operable to actuate, drive, operate, or otherwise control one or more of the fluid control devices 130, 132, 138. The power unit 137 may be or comprise a hydraulic fluid power unit fluidly connected with the fluid control devices 130, 132, 138 and selectively operable to hydraulically drive various portions (e.g., rams, valves, seals) of the fluid control devices 130, 132, 138.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding the drilling fluid 140 (i.e., drilling mud), and one or more mud pumps 144 (i.e., drilling fluid pumps) operable to move the drilling fluid 140 from the container 142 into the fluid passage 121 of the drill string 120 via a fluid conduit 146 extending from the pumps 144 to the top drive 116 and an internal passage extending through the top drive 116. The fluid conduit 146 may comprise one or more of a pump discharge line, a stand pipe, a rotary hose, and a gooseneck connected with a fluid inlet of the top drive 116. The pumps 144 and the container 142 may be fluidly connected by a fluid conduit 148, such as a suction line.

A flow rate sensor 147 may be operatively connected along the fluid conduit 146 to measure flow rate of the drilling fluid 140 being pumped downhole. The flow rate sensor 147 may be operable to measure volumetric and/or mass flow rate of the drilling fluid 140. The flow rate sensor 147 may be an electrical flow rate sensor operable to output electrical sensor data indicative of the measured flow rate. The flow rate sensor 146 may be a Coriolis flowmeter, a turbine flowmeter, or an acoustic flowmeter, among other examples. A pressure sensor 149 may be connected along the fluid conduit 146, such as to measure the pressure of the drilling fluid 140 being pumped downhole. The pressure sensor 149 may be connected close to the top drive 116, such as may permit the pressure sensor 149 to measure the pressure within the drill string 120 at the top of the internal passage 121 or otherwise proximate the wellsite surface 104. The pressure sensor 146 may be an electrical sensor operable to output electric sensor data indicative of the drilling fluid pressure.

During drilling operations, the drilling fluid may continue to flow downhole through the internal passage 121 of the drill string 120, as indicated by directional arrow 131. The drilling fluid may exit the BHA 124 via ports 128 in the drill bit 126 and then circulate uphole through an annular space 108 ("annulus") of the wellbore 102 defined between an exterior of the drill string 120 and the wall of the wellbore 102, such flow being indicated by directional arrows 133. In this manner, the drilling fluid lubricates the drill bit 126 and carries formation cuttings uphole to the wellsite surface 104. The returning drilling fluid may exit the annulus 108 via different fluid control devices during different phases or scenarios of well drilling operations. For example, the drilling fluid may exit the annulus 108 via a bell nipple 139, the RCD 138, or a ported adapter 136 (e.g., a spool, cross adapter, a wing valve, etc.) located below one or more rams of the BOP stack 130.

During normal drilling operations, the drilling fluid may exit the annulus 108 via the bell nipple 139 and then be directed toward drilling fluid reconditioning equipment 170 via a fluid conduit 158 (e.g., gravity return line) to be cleaned and/or reconditioned, as described below, before being returned to the container 142 for recirculation. A flow rate sensor 151 may be connected along the fluid conduit 158 to monitor the flow rate of the returning wellbore fluid (e.g., drilling fluid, formation fluid) being discharged from the wellbore 102.

During managed pressure drilling operations, the drilling fluid may exit the annulus 108 via the RCD 138 and then be directed into a choke manifold 152 (e.g., a managed pressure drilling choke manifold) via a fluid conduit 150 (e.g., a drilling pressure control line). The choke manifold 152 may include at least one choke and a plurality of fluid valves (neither shown) collectively operable to control the flow through and out of the choke manifold 152. Backpressure may be applied to the annulus 108 by variably restricting flow of the drilling fluid or other fluids flowing through the choke manifold 152. The greater the restriction to flow through the choke manifold 152, the greater the backpressure applied to the annulus 108. The drilling fluid exiting the choke manifold 152 may then pass through the drilling fluid reconditioning equipment 170 before being returned to the container 142 for recirculation. During well pressure control operations, such as when one or more rams of the BOP stack 130 is closed, the drilling fluid may exit the annulus 108 via the ported adapter 136 and be directed into a choke manifold 156 (e.g., a rig choke manifold, well control choke manifold) via a fluid conduit 154 (e.g., rig choke line). The choke manifold 156 may include at least one choke and a plurality of fluid valves (neither shown) collectively operable to control the flow of the drilling fluid through the choke manifold 156. Backpressure may be applied to the annulus 108 by variably restricting flow of the drilling fluid (and other fluids) flowing through the choke manifold 156. The drilling fluid exiting the choke manifold 156 may then pass through the drilling fluid reconditioning equipment 170 before being returned to the container 142 for recirculation.

Before being returned to the container 142, the drilling fluid returning to the wellsite surface 104 may be cleaned and/or reconditioned via the drilling fluid reconditioning equipment 170, which may include one or more of liquid gas (i.e., mud gas) separators 171, shale shakers 172, and other drilling fluid cleaning and reconditioning equipment 173. The liquid gas separators 171 may remove formation gasses entrained in the drilling fluid discharged from the wellbore 102 and the shale shakers 172 may separate and remove solid particles 141 (e.g., drill cuttings) from the drilling fluid. The drilling fluid reconditioning equipment 170 may further comprise other equipment 173 operable to remove additional gas and finer formation cuttings from the drilling fluid and/or modify chemical and/or physical properties or characteristics (e.g., rheology, density) of the drilling fluid. For example, the drilling fluid reconditioning equipment 170 may include a degasser, a desander, a desilter, a centrifuge, a mud cleaner, and/or a decanter, among other examples. The drilling fluid reconditioning equipment 170 may further include chemical containers and mixing equipment collectively operable to mix or otherwise add selected chemicals to the drilling fluid returning from the wellbore 102 to modify chemical and/or physical properties or characteristics of the drilling fluid being pumped back into the wellbore 102. Intermediate tanks/containers (not shown) may be utilized to hold the drilling fluid while the drilling fluid progresses through the various stages or portions 171, 172, 173 of the drilling fluid reconditioning equipment 170. The cleaned and reconditioned drilling fluid may be transferred to the fluid container 142, the solid particles 141 removed from the drilling fluid may be transferred to a solids container 143 (e.g., a reserve pit), and/or the removed gas may be transferred to a flare stack 174 via a conduit 175 (e.g., a flare line) to be burned or to a container (not shown) for storage and removal from the wellsite.

The surface equipment 110 may include a tubular handling system or equipment operable to store, move, connect, and disconnect tubulars (e.g., drill pipes) to assemble and disassemble the conveyance means 122 of the drill string 120 during drilling operations. For example, a catwalk 161 may be utilized to convey tubulars from a ground level, such as along the wellsite surface 104, to the rig floor 114, permitting the elevator 129 to grab and lift the tubulars above the wellbore 102 for connection with previously deployed tubulars. The catwalk 161 may have a horizontal portion and an inclined portion that extends between the horizontal portion and the rig floor 114. The catwalk 161 may comprise a skate 163 movable along a groove (not shown) extending longitudinally along the horizontal and inclined portions of the catwalk 161. The skate 163 may be operable to convey (e.g., push) the tubulars along the catwalk 161 to the rig floor 114. The skate 163 may be driven along the groove by a drive system (not shown), such as a pulley system or a hydraulic system. Additionally, one or more racks (not shown) may adjoin the horizontal portion of the catwalk 161. The racks may have a spinner unit for transferring tubulars to the groove of the catwalk 161.

An iron roughneck 165 may be positioned on the rig floor 114. The iron roughneck 165 may comprise a torqueing portion 167, such as may include a spinner and a torque wrench comprising a lower tong and an upper tong. The torqueing portion 167 of the iron roughneck 165 may be moveable toward and at least partially around the drill string 120, such as may permit the iron roughneck 165 to make up and break out connections of the drill string 120. The torqueing portion 167 may also be moveable away from the drill string 120, such as may permit the iron roughneck 165 to move clear of the drill string 120 during drilling operations. The spinner of the iron roughneck 165 may be utilized to apply low torque to make up and break out threaded connections between tubulars of the drill string 120, and the torque wrench may be utilized to apply a higher torque to tighten and loosen the threaded connections.

A set of slips 119 may be located on the rig floor 114, such as may accommodate therethrough the drill string 120 during tubular make up and break out operations and during the drilling operations. The slips 119 may be in an open position during drilling operations to permit advancement of the drill string 120, and in a closed position to clamp the upper end (e.g., the uppermost tubular) of the drill string 120 to thereby suspend and prevent advancement of the drill string 120 within the wellbore 102, such as during the make up and break out operations.

During drilling operations, the various well construction equipment of the well construction system 100 may progress through a plurality of coordinated operations (i.e., operational sequences) to drill or otherwise construct the wellbore 102. The operational sequences may change based on a well construction plan, status of the well, status of the subterranean formation, stage of drilling operations (e.g., tripping, drilling, tubular handling, etc.), and type downhole tubulars (e.g., drill pipe) utilized, among other examples.

During drilling operations, the hoisting system lowers the drill string 120 while the top drive 116 rotates the drill string 120 to advance the drill string 120 downward within the wellbore 102 and into the formation 106. During the advancement of the drill string 120, the slips 119 are in an open position, and the iron roughneck 165 is moved away or is otherwise clear of the drill string 120. When the upper end of the drill string 120 (i.e., upper end of the uppermost tubular of the drill string 120) connected to the drive shaft 125 is near the slips 119 and/or the rig floor 114, the top drive 116 ceases rotating and the slips 119 close to clamp the upper end of the drill string 120. The grabber of the top drive 116 then clamps the uppermost tubular connected to the drive shaft 125, and the drive shaft 125 rotates in a direction reverse from the drilling rotation to break out the connection between the drive shaft 125 and the uppermost tubular. The grabber of the top drive 116 may then release the uppermost tubular.

Multiple tubulars may be loaded on the rack of the catwalk 161 and individual tubulars may be transferred from the rack to the groove in the catwalk 161, such as by the spinner unit. The tubular positioned in the groove may be conveyed along the groove by the skate 163 until the box end of the tubular projects above the rig floor 114. The elevator 129 of the top drive 116 then grasps the protruding box end, and the drawworks 118 may be operated to lift the top drive 116, the elevator 129, and the new tubular.

The hoisting system then raises the top drive 116, the elevator 129, and the new tubular until the tubular is aligned with the upper portion of the drill string 120 clamped by the slips 119. The iron roughneck 165 is moved toward the drill string 120, and the lower tong of the torqueing portion 167 clamps onto the upper end of the drill string 120. The spinning system threadedly connects the lower end (i.e., pin end) of the new tubular with the upper end (i.e., box end) of the drill string 120. The upper tong then clamps onto the new tubular and rotates with high torque to complete making up the connection with the drill string 120. In this manner, the new tubular becomes part of the drill string 120. The iron roughneck 165 then releases and moves clear of the drill string 120.

The grabber of the top drive 116 may then clamp onto the drill string 120. The drive shaft 125 is brought into contact with the upper end of the drill string 120 (e.g., the box end of the uppermost tubular) and rotated to make up a connection between the drill string 120 and the drive shaft 125. The grabber then releases the drill string 120, and the slips 119 are moved to the open position. The drilling operations may then resume.

The tubular handling equipment may further include a tubular handling manipulator (THM) 160 disposed in association with a vertical pipe rack 162 for storing tubulars 111 (e.g., drill pipes, drill collars, drill pipe stands, casing joints, etc.). The vertical pipe rack 162 may comprise or support a fingerboard 164 defining a plurality of slots configured to support or otherwise hold the tubulars 111 within or above a setback 166 (e.g., a platform or another area) located adjacent to, along, or below the rig floor 114. The fingerboard 164 may comprise a plurality of fingers (not shown), each associated with a corresponding slot and operable to close around and/or otherwise interpose individual tubulars 111 to maintain the tubulars 111 within corresponding slots of the fingerboard 164. The vertical pipe rack 162 may be connected with and supported by the support structure 112 or another portion of the wellsite system 100. The fingerboard 164/setback 166 provide storage (e.g., temporary storage) of tubulars 111 during various operations, such as during and between tripping out and tripping of the drill string 120. The THM 160 may be operable to transfer the tubulars 111 between the fingerboard 164/setback 166 and the drill string 120 (i.e., space above the suspended drill string 120). For example, the THM 160 may include arms 168 terminating with clamps 169, such as may be operable to grasp and/or clamp onto one of the tubulars 111. The arms 168 of the THM 160 may extend and retract, and/or at least a portion of the THM 160 may be rotatable and/or movable toward and away from the drill string 120, such as may permit the THM 160 to transfer the tubular 111 between the fingerboard 164/setback 166 and the drill string 120.

To trip out the drill string 120, the top drive 116 is raised, the slips 119 are closed around the drill string 120, and the elevator 129 is closed around the drill string 120. The grabber of the top drive 116 clamps the upper end of a tubular of the drill string 120 coupled to the drive shaft 125. The drive shaft 125 then rotates in a direction reverse from the drilling rotation to break out the connection between the drive shaft 125 and the drill string 120. The grabber of the top drive 116 then releases the tubular of the drill string 120, and the drill string 120 is suspended by (at least in part) the elevator 129. The iron roughneck 165 is moved toward the drill string 120. The lower tong clamps onto a lower tubular below a connection of the drill string 120, and the upper tong clamps onto an upper tubular above that connection. The upper tong then rotates the upper tubular to provide a high torque to break out the connection between the upper and lower tubulars. The spinning system then rotates the upper tubular to separate the upper and lower tubulars, such that the upper tubular is suspended above the rig floor 114 by the elevator 129. The iron roughneck 165 then releases the drill string 120 and moves clear of the drill string 120.

The THM 160 may then move toward the drill string 120 to grasp the tubular suspended from the elevator 129. The elevator 129 then opens to release the tubular. The THM 160 then moves away from the drill string 120 while grasping the tubular with the clamps 169, places the tubular in the fingerboard 164/setback 166, and releases the tubular for storage. This process is repeated until the intended length of drill string 120 is removed from the wellbore 102.

The surface equipment 110 of the well construction system 100 may also comprise a control center 190 from which various portions of the well construction system 100, such as the top drive 116, the hoisting system, the tubular handling system, the drilling fluid circulation system, the well control system, the BHA 124, among other examples, may be monitored and controlled. The control center 190 may be located on the rig floor 114 or another location of the well construction system 100. The control center 190 may comprise a facility 191 (e.g., a room, a cabin, a trailer, etc.) containing a control workstation 197, which may be operated by rig personnel 195 (e.g., a driller or another human rig operator) to monitor and control various well construction equipment or portions of the well construction system 100. The control workstation 197 may comprise or be communicatively connected with a central controller 192 (e.g., a processing device, a computer, etc.), such as may be operable to receive, process, and output information to monitor operations of and provide control to one or more portions of the well construction system 100. For example, the central controller 192 may be communicatively connected with the various surface and downhole equipment described herein, and may be operable to receive signals from and transmit signals to such equipment to perform various operations described herein. The central controller 192 may store executable computer program code, instructions, and/or operational parameters or set-points, including for implementing one or more aspects of methods and operations described herein. The central controller 192 may be located within and/or outside of the facility 191.

The control workstation 197 may be operable for entering or otherwise communicating control data (e.g., commands, signals, information, etc.) to the central controller 192 and other equipment controller by the rig personnel 195, and for displaying or otherwise communicating information from the central controller 192 to the rig personnel 195. The control workstation 197 may comprise a plurality of human-machine interface (HMI) devices, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the central controller 192, the input and output devices 194, 196, and the various well construction equipment may be via wired and/or wireless communication means. However, for clarity and ease of understanding, such communication means are not depicted, and a person having ordinary skill in the art will appreciate that such communication means are within the scope of the present disclosure.

The well construction system 100 also includes stationary and/or mobile video cameras 198 disposed or utilized at various locations within the well construction system 100. The video cameras 198 capture videos of various portions, equipment, or subsystems of the well construction system 100, and perhaps the rig personnel 195 and the actions they perform, during or otherwise in association with the wellsite operations, including while performing repairs to the well construction system 100 during a breakdown. For example, the video cameras 198 may capture videos of the entire well construction system 100 and/or specific portions of the well construction system 100, such as the top drive 116, the iron roughneck 165, the THM 160, the fingerboard 164, and/or the catwalk 161, among other examples. The video cameras 198 generate corresponding video signals (i.e., video feeds) comprising or otherwise indicative of the captured videos. The video cameras 198 may be in signal communication with the central controller 192, such as may permit the video signals to be processed and transmitted to the control workstation 197 and, thus, permit the rig personnel 195 to view various portions or components of the well construction system 100 on one or more of the output devices 196. The central controller 192 or another portion of the control workstation 197 may be operable to record the video signals generated by the video cameras 198.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

Figure 2:
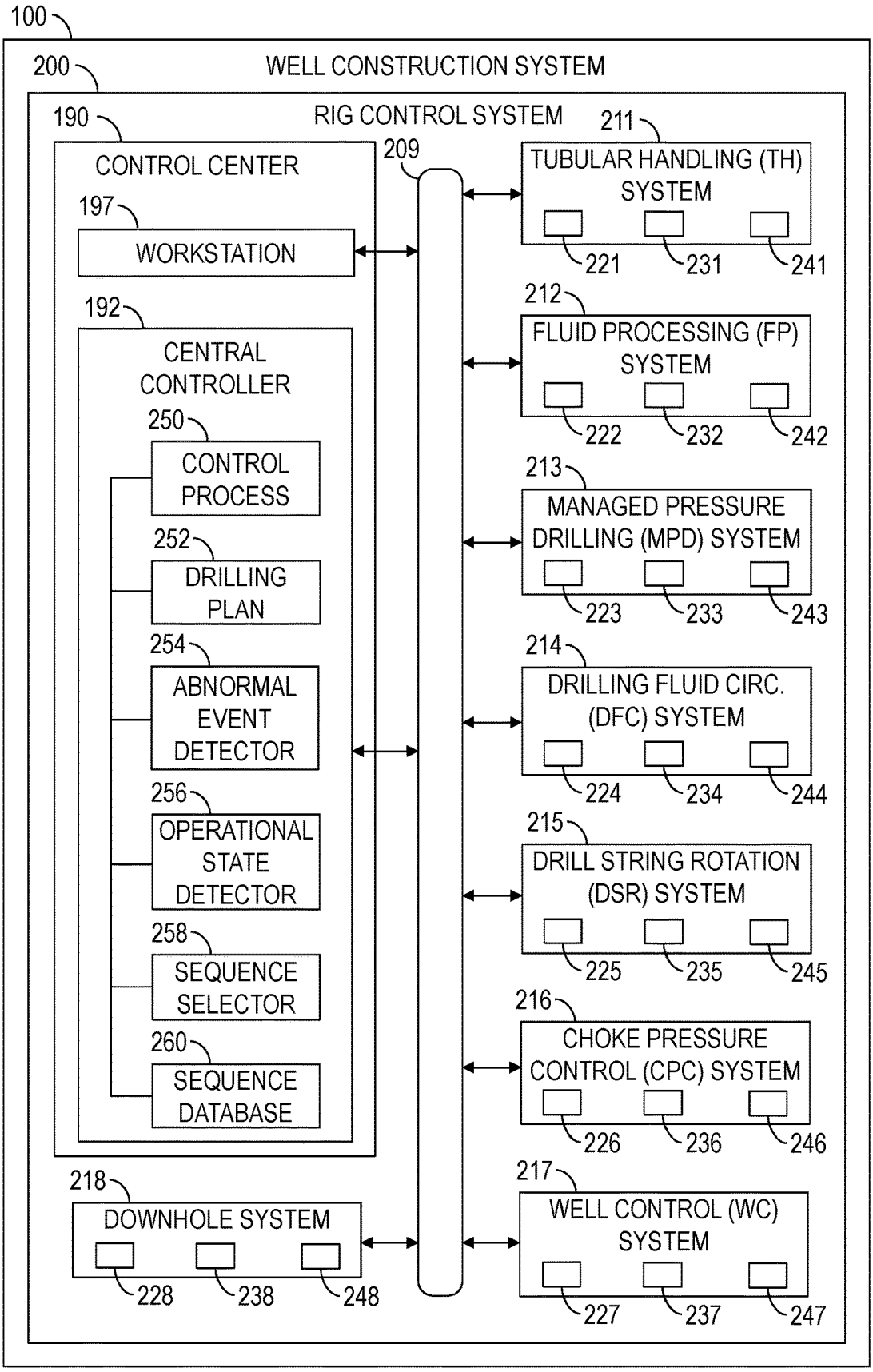
FIG. 2 is a schematic view of at least a portion of an example implementation of apparatus according to one or more aspects of the present disclosure.

The present disclosure further provides various implementations of systems and/or methods for controlling one or more portions of the well construction system 100. FIG. 2 is a schematic view of at least a portion of an example implementation of a drilling rig control system 200 (hereinafter "rig control system") for monitoring and controlling various equipment, portions, and subsystems of the well construction system 100 shown in FIG. 1. The rig control system 200 may comprise one or more features of the well construction system 100, including where indicated by the same reference numbers. Accordingly, the following description refers to FIGS. 1 and 2, collectively.

The various pieces of well construction equipment described above and shown in FIGS. 1 and 2 may each comprise one or more (e.g., combustion, hydraulic, and/or electrical) actuators, which when operated, may cause the corresponding well construction equipment to perform intended actions (e.g., work, tasks, movements, operations, etc.). Each piece of well construction equipment may further carry or comprise one or more sensors disposed in association with a corresponding actuator or another portion of the piece of equipment. Each sensor may be communicatively connected with a corresponding equipment controller and operable to generate sensor data (e.g., electrical sensor signals or measurements) indicative of an operational (e.g., mechanical, physical) status of the corresponding actuator or component, thereby permitting the operational status of the actuator to be monitored by the equipment controller. The sensor data may be utilized by the equipment controller as feedback data, permitting operational control of the piece of well construction equipment and coordination with other well construction equipment. Such sensor data may be indicative of performance of each individual actuator and, collectively, of the entire piece of well construction equipment.

The rig control system 200 may be in real-time communication with and utilized to monitor and/or control various portions, components, and equipment of the well construction system 100 described herein. The equipment of the well construction system 100 may be grouped into several subsystems, each operable to perform a corresponding operation and/or a portion of the well construction operations described herein. The subsystems may include a tubular handling (TH) system 211, a fluid processing (FP) system 212, a managed pressure drilling (MPD) system 213, a drilling fluid circulation (DFC) system 214, a drill string rotation system (DSR) system 215, a choke pressure control (CPC) system 216, a well pressure control (WC) system 217, and a downhole system 218. The control workstation 197 may be utilized to monitor, configure, control, and/or otherwise operate one or more of the subsystems 211-218.

The TH system 211 may include the support structure 112, a tubular hoisting system (e.g., the drawworks 118, the elevator links 127, the elevator 129, the slips 119), a tubular handling system or equipment (e.g., the catwalk 161, the THM 160, the setback 166, and the iron roughneck 165), electrical generators, and other equipment. Accordingly, the TH system 211 may perform power generation controls, and tubular handling and hoisting operations. The TH system 211 may also serve as a support platform for tubular rotation equipment and staging ground for rig operations, such as connection make up and break out operations described above. The FP system 212 may include the drilling fluid reconditioning equipment 170, the flare stack 174, the containers 142, 143, and/or other equipment. Accordingly, the FP system 212 may perform fluid cleaning, reconditioning, and mixing operations. The MPD system 213 may include the RCD 138, the power unit 137, the choke manifold 152, a downhole pressure sensor 186, and/or other equipment. The DFC system 214 may comprise the pumps 144, the drilling fluid container 142, the bell nipple 139, and/or other equipment collectively operable to pump and circulate the drilling fluid at the wellsite surface and downhole. The DSR system 215 may include the top drive 116 and/or the rotary table and kelly. The CPC system 216 may comprise the choke manifold 156, the ported adapter 136, and/or other equipment, and the WC system 217 may comprise the BOP stack 130, the power unit 137, and a BOP control station for controlling the power unit 137. The downhole system 218 may be used to drill the wellbore 102 and to monitor various downhole parameters while performing the drilling operations. The downhole system 218 may comprise the drill string 120, including various portions of the BHA 124, such as the downhole tools 180, 182, the mud motor 184, and the drill bit 126. The local controller 228 may be or comprise the downhole controller 188, the sensors 238 may be or comprise the sensors 186 and the telemetry device 187, and the actuators 248 may be or comprise various actuators of the BHA 124, such as steering actuators operable to control trajectory of the BHA 124 during drilling operations. Each of the well construction subsystems 211-218 may further comprise various communication equipment (e.g., modems, network interface cards, etc.) and communication conductors (e.g., cables), communicatively connecting the equipment (e.g., sensors and actuators) of each subsystem 211-218 with the control workstation 197 and/or other equipment. Although the well construction equipment listed above and shown in FIG. 1 is associated with certain wellsite subsystems 211-218, such associations are merely examples that are not intended to limit or prevent such well construction equipment from being associated with two or more wellsite subsystems 211-218 and/or different wellsite subsystems 211-218.

The rig control system 200 may include various local controllers 221-228, each operable to control various well construction equipment of a corresponding subsystem 211-218 and/or an individual piece of well construction equipment of a corresponding subsystem 211-218. As described above, each well construction subsystem 211-218 includes various well construction equipment comprising corresponding actuators 241-248 for performing operations of the well construction system 100. Each subsystem 211-218 may include various sensors 231-238 operable to generate sensor data (e.g., signals, information, measurements) indicative of operational status of the well construction equipment of each subsystem 211-218. Each local controller 221-228 may output control data (e.g., commands, signals, information) to one or more actuators 241-248 to perform corresponding actions of a piece of equipment or subsystem 211-218. Each local controller 221-228 may receive sensor data generated by one or more sensors 231-238 indicative of operational status of an actuator or another portion of a piece of equipment or subsystem 211-218. Although the local controllers 221-228, the sensors 231-238, and the actuators 241-248 are each shown as a single block, it is to be understood that each local controller 221-228, sensor 231-238, and actuator 241-248 may be or comprise a plurality of local controllers, sensors, and actuators.

The sensors 231-238 may include sensors utilized for operation of the various subsystems 211-218 of the well construction system 100. For example, the sensors 231-238 may include cameras, position sensors, pressure sensors, temperature sensors, flow rate sensors, vibration sensors, current sensors, voltage sensors, resistance sensors, gesture detection sensors or devices, voice actuated or recognition devices or sensors, and/or other examples. The sensor data may include signals, information, and/or measurements indicative of equipment operational status (e.g., on or off, up or down, set or released, etc.), drilling parameters (e.g., depth, hook load, torque, etc.), auxiliary parameters (e.g., vibration data of a pump), flow rate, temperature, operational speed, position, and pressure, among other examples. The acquired sensor data may include or be associated with a timestamp (e.g., date and/or time) indicative of when the sensor data was acquired. The sensor data may also or instead be aligned with a depth or other drilling parameter.

The local controllers 221-228, the sensors 231-238, and the actuators 241-248 may be communicatively connected with a central controller 192. For example, the local controllers 221-228 may be in communication with the sensors 231-238 and actuators 241-248 of the corresponding subsystems 211-218 via local communication networks (e.g., field buses) (not shown) and the central controller 192 may be in communication with the subsystems 211-218 via a central communication network 209 (e.g., a data bus, a field bus, a wide-area-network (WAN), a local-area-network (LAN), etc.). The sensor data generated by the sensors 231-238 of the subsystems 211-218 may be made available for use by the central controller 192 and/or the local controllers 221-228. Similarly, control data output by the central controller 192 and/or the local controllers 221-228 may be automatically communicated to the various actuators 241-248 of the subsystems 211-218, perhaps pursuant to predetermined programming, such as to facilitate well construction operations and/or other operations described herein. Although the central controller 192 is shown as a single device (i.e., a discrete hardware component), it is to be understood that the central controller 192 may be or comprise a plurality of equipment controllers and/or other electronic devices collectively operable to perform operations (i.e., computational processes or methods) described herein.

The sensors 231-238 and actuators 241-248 may be monitored and/or controlled by corresponding local controllers 221-228 and/or the central controller 192. For example, the central controller 192 may be operable to receive sensor data from the sensors 231-238 of the wellsite subsystems 211-218 in real-time, and to output real-time control data directly to the actuators 241-248 of the subsystems 211-218 based on the received sensor data. However, certain operations of the actuators 241-248 of each subsystem 211-218 may be controlled by a corresponding local controller 221-228, which may control the actuators 241-248 based on sensor data received from the sensors 231-238 of the corresponding subsystem 211-218 and/or based on control data received from the central controller 192.

The rig control system 200 may be a tiered control system, wherein control of the subsystems 211-218 of the well construction system 100 may be provided via a first tier of the local controllers 221-228 and a second tier of the central controller 192. The central controller 192 may facilitate control of one or more of the subsystems 211-218 at the level of each individual subsystem 211-218. For example, in the FP system 212, sensor data may be fed into the local controller 242, which may respond to control the actuators 232. However, for control operations that involve multiple subsystems 211-218, the control may be coordinated through the central controller 192 operable to coordinate control of well construction equipment of two, three, four, or more (each) of the subsystems 211-218. For example, coordinated control operations may include the control of downhole pressure during tripping. The downhole pressure may be affected by the DFC system 214 (e.g., pump rate), the MPD system 213 (e.g., position of the choke 152), and the TH system 211 (e.g., tripping speed). Thus, when it is intended to maintain certain downhole pressure during tripping, the central controller 192 may output control data to two or more of the participating subsystems 211-218.

As described above, the central controller 192 may control various operations of the subsystems 211-218 via analysis of sensor data from one or more of the wellsite subsystems 211-218 to facilitate coordinated control between the subsystems 211-218. The central controller 192 may generate control data to coordinate operations of various well construction equipment of the subsystems 211-218. The control data may include, for example, commands from rig personnel, such as turn on or turn off a pump, switch on or off a fluid valve, and update a physical property set-point, among other examples. The local controllers 221-228 may each include a fast control loop that directly obtains sensor data and executes, for example, a control algorithm to generate the control data. The central controller 192 may include a slow control loop to periodically obtain sensor data and generate the control data.

The rig control system 200, including the central controller 192 and the local controllers 221-228, facilitates operation of the well construction equipment in an equipment focused manner, such as to maintain the choke pressure to a certain value or to rotate the drill string at a certain rotational speed. The rig control system 200 may also coordinate operations of certain pieces of equipment to achieve intended operations, such as to move a tubular from the fingerboard to the well center, break up a tubular stand from the well center, or rack an individual tubular back to the fingerboard. Each such operation utilizes coordinated control of multiple pieces of pipe handling equipment by the central controller 192.

The downhole controller 188, the central controller 192, the local controllers 221-228, and/or other controllers or processing devices (individually or collectively referred to hereinafter as an "equipment controller") of the rig control system 200 may each or collectively be operable to receive and store machine-readable and executable program code instructions (e.g., computer program code, algorithms, programmed processes or operations) on a memory device (e.g., a memory chip) and then execute the program code instructions to run, operate, or perform a control process for monitoring and/or controlling the well construction equipment of the well construction system 100. The central controller 192 may run (i.e., execute) a control process 250 (e.g., a coordinated control process or anther computer process) and each local controller 221-228 may run a corresponding control process (e.g., a local control process or another computer process, not shown). Two or more of the local controllers 221-228 may run their local control processes to collectively coordinate operations between well construction equipment of two or more of the subsystems 211-218.

The control process 250 of the central controller 192 may operate as a mechanization manager of the rig control system 190, coordinating operational sequences of the well construction equipment of the well construction system 100. The well construction system 100 may instead be operated manually by rig personnel (e.g., a driller). During such manual operation, the rig personnel operates as the mechanization manager of the rig control system 190 by manually coordinating operations of various well construction equipment, such as to achieve an intended operational status (or drilling state) of the well construction operations, including tripping in or drilling at an intended rate of penetration (ROP). The control process of each local controller 221-228 may facilitate a lower (e.g., basic) level of control within the rig control system 200 to operate a corresponding piece of well construction equipment or a plurality of pieces of well construction equipment of a corresponding subsystem 211-218. Such control process may facilitate, for example, starting, stopping, and setting or maintaining an operating speed of a piece of well construction equipment. During manual operation of the well construction system 100, rig personnel manually controls the individual pieces of well construction equipment to achieve the intended operational status of each piece of well construction equipment.

The control process 250 of the central controller 192 may output control data directly to the actuators 241-248 to control the well construction operations. The control process 250 may also or instead output control data to the control process of one or more local controllers 221-228, wherein each control process of the local controllers 221-228 may then output control data to the actuators 241-248 of the corresponding subsystem 211-218 to control a portion of the well construction operations performed by that subsystem 211-218. Thus, the control processes of equipment controllers (e.g., central controller 192, local controllers 221-228) of the rig control system 200 individually and collectively perform monitoring and control operations described herein, including monitoring and controlling well construction operations. The program code instructions forming the basis for the control processes described herein may comprise rules (e.g., algorithms) based upon the laws of physics for drilling and other well construction operations.

Each control process being run by an equipment controller of the rig control system 200 may receive and process (i.e., analyze) sensor data from the sensors 231-238 according to the program code instructions, and generate control data (i.e., control signals or information) to operate or otherwise control the actuators 241-248 of the well construction equipment. Equipment controllers within the scope of the present disclosure can include, for example, programmable logic controllers (PLCs), industrial computers (IPCs), personal computers (PCs), soft PLCs, variable frequency drives (VFDs) and/or other controllers or processing devices operable to store and execute program code instructions, receive sensor data, and output control data to cause operation of the well construction equipment based on the program code instructions, sensor data, and/or control data.

A control workstation 197 may be communicatively connected with the central controller 192 and/or the local controllers 221-228 via the communication network 209 and operable to receive sensor data from the sensors 231-238 and transmit control data to the central controller 192 and/or the local controllers 221-228 to control the actuators 241-248. Accordingly, the control workstation 197 may be utilized by rig personnel (e.g., a driller) to monitor and control the actuators 241-248 and other portions of the subsystems 211-218 via the central controller 192 and/or local controllers 221-228. The central controller 192 may be located within or form a portion of a control center 190.

An equipment controller of the rig control system 200 for controlling the well construction system 100 may be operable to automate the well construction equipment to perform well construction operations and change such well construction operations as operational parameters of the well construction operations change and/or when an abnormal event (e.g., state, condition) is detected during the well construction operations. An equipment controller may be operable to detect an abnormal event based on the sensor data received from the sensors 231-238 and cause the predetermined operations to be performed or otherwise implemented to stop or mitigate the abnormal event or otherwise in response to the abnormal event, without manual control of the well construction equipment by the rig personnel via the control workstation 197. For example, an equipment controller may be operable to make decisions related to selection of actions or sequences of operations that are to be implemented during the well construction operations and/or the manner (e.g., speed, torque, power, etc.) in which such selected operational sequences are to be implemented to stop or mitigate a detected abnormal event. An equipment controller may be further operable to receive and store information that may be analyzed by the control process to facilitate the equipment controller to detect the abnormal event, and select and implement the operational sequences to stop or mitigate the abnormal event.

FIG. 2 shows the central controller 192 implemented as an equipment controller operable to perform or otherwise implement the monitoring and control operations according to one or more aspects of the present disclosure. Namely, the central controller 192 is shown comprising features (e.g., programs, applications, databases, etc.) that permit the central controller 192 to perform or otherwise implement such monitoring and control operations. However, it is to be understood that one or more of the local controllers 221-228 may also or instead be implemented as the equipment controller(s) operable to perform or otherwise implement such monitoring and control operations.

The central controller 192 may comprise a memory device operable to receive and store a well construction plan 252 (e.g., a drilling plan) for drilling and/or otherwise constructing a planned well. The well construction plan 252 may include well specifications, operational parameters, schedules, and other information indicative of the planned well and the well construction equipment of the well construction system 100. For example, the well construction plan 252 may include properties of the subterranean formation through which the planned well is to be drilled, the path (e.g., direction, curvature, orientation) along which the planned well is to be drilled through the formation, the depth (e.g., true vertical depth (TVD), measured depth (MD)) of the planned well, operational specifications (e.g., power output, weight, torque capabilities, speed capabilities, dimensions, size, etc.) of the well construction equipment (e.g., top drive, mud pumps, 144, downhole mud motor 184, etc.) that is planned to be used to construct the planned well, and/or specifications (e.g., diameter, length, weight, etc.) of tubulars (e.g., drill pipe) that are planned to be used to construct the planned well. The well construction plan 252 may further include planned operational parameters of the well construction equipment during the well construction operations, such as weight on bit (WOB), top drive speed (RPM), and ROP as a function of wellbore depth.

The well construction plan 252 may further include well construction operations schedule and/or a plurality of planned well construction tasks (i.e., well construction objectives) that are intended to be achieved to complete the well construction plan 252. Each planned task may comprise a plurality of operational sequences and may be performed by the well construction equipment to construct the planned well. A planned task may be or comprise drilling a predetermined portion or depth of the planned well, completing a predetermined portion or stage of drilling operations, drilling through a predetermined section of the subterranean formation, and performing a predetermined plurality of operational sequences, among other examples. Each operational sequence may comprise a plurality or sequence of physical (i.e., mechanical) operations (i.e., actions) performed by various pieces of well construction equipment. Example operational sequences may include operations of one or more pieces of the well construction equipment of the well construction system 100 described above in association with FIG. 1.

The well construction plan 252 may include knowledge (e.g., efficiency of various parameters) learned from offset wells that have been drilled. Optimal parameters associated with the offset wells may then be used as the recommended parameters in a current well construction plan 252. The knowledge learned from the offset wells, including operation limits, such as maximum WOB, RPM, ROP, and/or tripping speed versus depth, may be applied and used as an operation limit within the well construction plan 252. The information forming of otherwise from the well construction plan 252 may originate or be delivered in a paper form, whereby rig personnel manually input such information into the central controller 192. However, the information forming the well construction plan 252 may originate or be delivered in digital format, such that it can be directly loaded to or saved by a memory device of the central controller 192.

The well construction plan 252 can be executed or analyzed programmatically by a computer process (e.g., control process 250) of the central controller 192 without human intervention. The memory device storing the well construction plan 252 may be or form a portion of the central controller 192 or the memory device storing the well construction plan 252 may be communicatively connected with the central controller 192. The computer process ran by the central controller 192 may analyze the well construction plan 252 and generate or output control data to the local controllers 221-228 or directly to the actuators 241-248 to control the well construction equipment to cause, facilitate, or otherwise implement one or more aspects of methods and operations described herein.

The central controller 192 may be operable to receive and store machine-readable and executable program code instructions on a memory device and then execute the program code instructions to run, operate, or perform an abnormal event detector 254 (e.g., an abnormal event detecting computer process), which may be operable to analyze or otherwise process the sensor data received from the sensors 231-238 and detect an abnormal event (e.g., status, condition) experienced by or otherwise associated with one or more pieces of well construction equipment, and/or an abnormal event experienced by or otherwise associated with a wellbore (e.g., the wellbore 102 shown in FIG. 1). The abnormal event detector 254 may be operable to detect the abnormal events based on the sensor data and output abnormal event data indicative of the detected abnormal event. The central controller 192 may then re-plan well construction tasks, operational sequences, and other processes based on the detected abnormal events or otherwise based on the condition of the well and/or the well construction equipment.

For example, an abnormal event may be or comprise an abnormal operational surface event experienced by surface equipment (e.g., the surface equipment 110 shown in FIG. 1) and/or an abnormal operational downhole event experienced by a drill string (e.g., the drill string 120 shown in FIG. 1). An example abnormal operational downhole event may include stick slip, axial vibrations, lateral vibrations, rotational vibrations, and stuck drill pipe. The abnormal event may instead be or comprise an abnormal downhole fluid event experienced by a downhole fluid, such as wellbore fluid (e.g., drilling fluid, formation fluid) within the wellbore, and/or formation fluid within a rock formation (e.g., rock formation 106 shown in FIG. 1) through which the wellbore extends. An example abnormal downhole fluid event may include underpressure of the formation fluid, overpressure of the formation fluid, gains of the wellbore fluid, and losses of the wellbore fluid.

The central controller 192 may be operable to receive and store machine-readable and executable program code instructions on a memory device and then execute the program code instructions to run, operate, or perform an operational state detector 256 (e.g., an operational state detecting computer process), which may be operable to analyze or otherwise process the sensor data received from the sensors 231-238 and/or downhole sensors (e.g., downhole sensors 186 shown in FIG. 1) and detect a state (e.g., a status, a phase) of the well construction operations the well construction system 100 is performing. The operational state detector 256 may then output operational state data indicative of the operational state of the well construction system 100. Operational states of the well construction system 100 may comprise, for example, drilling, tripping, circulating, and reaming.

The central controller 192 may be operable to receive and store machine-readable and executable program code instructions on a memory device and then execute the program code instructions to run, operate, or perform an operational sequence selector 258 (e.g., an operational sequence selecting computer process) operable to select and output an operational sequence (e.g., a plurality or series of physical or mechanical operations, actions, or movements) to be performed by the well construction equipment. The operational sequence selector 258 (or generator) may be operable to receive and analyze or otherwise process various data to select (or generate) an operational sequence. For example, the operational sequence selector 258 may be operable to receive and analyze the well construction plan 252, the sensor data from the sensors 186, 231-238, the operational state data from the operational state detector 256, and/or the abnormal event data from the abnormal event detector 254, and select an (e.g., optimal) operational sequence to be performed by the well construction equipment based on such well construction plan 252, sensor data, operational state data, and/or abnormal event data.

The operational sequence selector 258 may be operable to analyze or otherwise process the well construction plan 252 and discretize (e.g., break up or segment) the well construction plan 252 into a plurality of planned tasks or operational sequences that can be implemented (i.e., caused to be performed) by the central controller 192. For example, the operational sequence selector 258 may be operable to analyze or otherwise process the well construction plan 252 and discretize each planned task (e.g., step) defined in the well construction plan 252 into one or more discrete operational sequences that can be received and implemented by the central controller 192. A planned task may include, for example, drilling from depth A to depth B with the set of operation parameters, performing a survey, or performing a telemetry operation. Thus, the operational sequence selector 258 may be operable to select an operational sequence to be performed by the well construction equipment to perform a planned task defined in the well construction plan 252. The control process 250 may then receive the selected operational sequence to be performed by the well construction equipment and, based on such selected operational sequence, output control data to cause the well construction equipment to perform the selected operational sequence and, thus, the corresponding planned task. The operational sequence selected and output by the operational sequence selector 258 based on the well construction plan 252 may be referred to hereinafter as a planned operational sequence.

The operational sequence selector 258 may also or instead be operable to analyze or otherwise process the detected abnormal event and select an operational sequence to be performed by the well construction equipment based on such abnormal event to stop or otherwise mitigate the detected abnormal event. The control process 250 may then receive the selected operational sequence to be performed by the well construction equipment and, based on such selected operational sequence, output control data to cause the well construction equipment to perform the selected operational sequence, thereby mitigating the abnormal downhole event. The control process 250 may cause the well construction equipment to perform the operational sequence selected based on the detected abnormal event while the planned operational sequence is still being performed. However, the control process 250 may instead output control data to cause the well construction equipment to stop performing the planned operational sequence, before outputting the control data to cause the well construction equipment to perform the operational sequence selected based on the detected abnormal event. The operational sequence selected and output by the operational sequence selector 258 based on the detected abnormal event may be referred to hereinafter as a mitigating operational sequence.

The central controller 192 may further comprise a memory device operable to receive and store a database 260 (e.g., a library) of operational sequences that may be performed by the well construction equipment. Each operational sequence may comprise a plurality or series of physical or mechanical operations (e.g., actions, movements) that may be performed by one or more pieces of the well construction equipment.

Some of the operational sequences (e.g., planned operational sequences) may be performed by corresponding pieces of the well construction equipment to perform a corresponding planned portion of the well construction operations (e.g., to drill a corresponding stage of the planned well). The database 260 may store operational sequences for performing each planned well construction task of the well construction plan 252. The database 260 may store a plurality of alternate operational sequences associated with (i.e., for performing) a planned well construction task or a procedure (e.g., a portion of a well construction task comprising a plurality of mechanical operations) to be performed by the well construction equipment, such as when a status or certain condition of well construction operations changes. Thus, each well construction task or procedure may be associated with a plurality of different and/or alternate planned operational sequences for performing a planned well construction task or procedure. Thus, each planned operational sequence associated with a planned well construction task may comprise a different plurality of actions or movements to be performed by the well construction equipment to perform the planned well construction task or procedure.

Some of the operational sequences (e.g., mitigating operational sequences) may be performed by corresponding pieces of the well construction equipment to stop or otherwise mitigate a detected abnormal event. The database 260 may store a plurality of alternate operational sequences associated with (i.e., for performing) various types and/or levels of abnormal events that can take place during well construction operations. For each abnormal event, one or more operational sequences may be defined in association with corresponding priority and/or decision making steps, and saved in the database 260 and/or as part of the operational sequence selector 258. The operational sequence selector 258 may automatically select one or more of the most responsive or optimal operational sequences based on parameters (e.g., type, severity, duration of time, etc.) of the abnormal event. Some abnormal events may be associated with a plurality of different and/or alternate planned operational sequences for performing a planned well construction task or procedure while stopping or otherwise mitigating the detected abnormal event and/or the effects of the detected abnormal event. Some abnormal events may be associated with a plurality of different and/or alternate planned operational sequences that are performed to stop or otherwise mitigate the detected abnormal event after a previously selected planned operational sequence is stopped. Thus, each mitigating operational sequence associated with a different abnormal event may comprise a different plurality of actions or movements to be performed by the well construction equipment to stop or otherwise mitigate the detected abnormal event. Thus, when an abnormal event is detected, the control process 250 may stop performance of a previously selected planned operational sequence, the operational sequence selector 258 may select a mitigating operational sequence based on the detected abnormal event, and the control process 250 may output control data to cause the well construction equipment to perform the selected mitigating operational sequence thereby mitigating the abnormal downhole event without manual control of the well construction equipment by the rig personnel via the control workstation 197.

The memory device storing the database 260 may be or form a portion of the central controller 192. For example, the database 260 may be stored on a memory device (e.g., a memory chip) of the central controller 192 that is different from the memory device on which the executable program code instructions for the control process 250 and/or the operational sequence selector 258 are stored. The database 260 may also or instead be stored on the same memory device that stores the executable program code instructions for the control process 250 and/or the operational sequence selector 258. The database 260 may also or instead be stored on a memory device external from the central controller 192 communicatively connected with the central controller 192. The database 260 may be or form a portion of the operational sequence selector 258 or the operational sequence selector 258 may have access to the planned and mitigating operational sequences stored in the database 260. Therefore, the operational sequence selector 258 may be operable to select from the database 260 an operational sequence to be performed by the well construction equipment.

The control process 250 is operable to receive a selected operational sequence from the sequence selector 258 and automatically operate the well construction equipment accordingly to implement the selected operational sequence. For example, if the selected operational sequence is to trip in a stand within a particular tripping speed, with the pump turned off, the control process 250 can ensure that the pump is turned off and that the drawworks is running at an intended speed. If the selected operational sequence is to trip in a drill string from depth A to depth B, which may mandate the well construction system 100 to run multiple stands automatically, the control process can automatically manage and synchronize multiple pieces of well construction equipment, including, tripping, setting slips, breaking connections, picking up a new stand, making connections, releasing slips, and tripping in, without manual control of the well construction equipment by rig personnel via the control workstation 197.

Thus, the present disclosure is directed to a control system 200 for monitoring and controlling the well construction equipment of the well construction system 100 (i.e., a well construction rig) according to one or more aspects of the present disclosure. The control system 200 comprises a plurality of sensors 186, 231-238 operable to output sensor data indicative of operational status of corresponding well construction equipment. The control system 200 further comprises an equipment controller 192, 221-228 communicatively connected with the sensors 186, 231-238 and the actuators 241-248 of the well construction equipment. The equipment controller 192, 221-228 may comprise a processing device and a memory storing an executable program code, which when executed, may run one or more computer processes 250, 254, 256, 258 for analyzing sensor data and other data.

The memory may store a well construction plan 252 for constructing a well. The well construction plan 252 may comprise at least one of a planned path along which the well is to be drilled through rock formation, a planned depth of the well, and operational parameters at which the well construction equipment is to be operated during the well construction operations. The memory may also or instead store a database 260 of planned and/or mitigating operational sequences to be performed by the well construction equipment.

During the well construction operations, the operational sequence selector 258 run (i.e., executed) by the equipment controller 192, 221-228 may be operable receive the sensor data from the sensors 186, 231-238 and analyze the sensor data to determine the operational status of the well construction equipment. The operational sequence selector 258 may further analyze the well construction plan 252. The operational sequence selector 258 may then select or otherwise output a planned operational sequence to be performed by the well construction equipment to perform a predetermined (e.g., next in order) planned task defined in the well construction plan 252. The operational sequence selector 258 may be operable to select the planned operational sequence to be performed by the well construction equipment from the database 260 based on the operational status of the well construction equipment and the well construction plan 252. For example, when the selected planned well construction task comprises drilling a selected portion of the planned well, the operational sequence selector 258 may be operable to select from the database 260 the operational sequence to be performed by the well construction equipment based on the operational status of the well construction equipment and the well construction plan 252.

The control process 250 run by the equipment controller 192 may then receive the selected planned operational sequence and output control data to relevant local controllers 221-228 or directly to the actuators 241-248 to cause the well construction equipment to implement (e.g., execute, perform) the selected planned operational sequence to perform the selected one or more of the planned tasks. The control process 250 may cause the well construction equipment to automatically perform the planned operational sequence to perform the selected planned well construction task without manual control of the well construction equipment by the rig personnel via the control workstation 197.

During the well construction operations, while each planned well construction task is being performed, the operational state detector 256 run by the equipment controller 192, 221-228 monitors (e.g., determines, calculates) the operational state of the well construction system 100 and the abnormal event detector 254 monitors the well construction system 100 for abnormal events. The operational sequence selector 258 may continuously receive sensor data from the various sensors 186, 231-238 associated with the well construction equipment, operational state data from the operational state detector 256, and continuously select from the database 260 an optimal one of the planned operational sequences to be performed by the well construction equipment based on the well construction plan 252, the sensor data, and the operational state data.

However, when an abnormal event takes place and is detected by the abnormal event detector 254 run by the equipment controller 192, 221-228 based on sensor data from the sensors 186, 231-238, the operational sequence selector 258 may then select a mitigating operational sequence to be performed by the well construction equipment based on the detected abnormal event, the operational state of the well construction system 100, and/or the well construction plan 252. The selected mitigating operational sequence may be received by the control process 250, which may then output control data to the local controllers 221-217 or directly of the actuators 241-248 to cause the well construction equipment to perform the selected mitigating operational sequence thereby stopping or mitigating the abnormal downhole event. Depending on the nature of the abnormal event, the selected mitigating operational sequence may have higher priority, and may interrupt the ongoing planned operational sequence. For example, the control process 250 may output control data to the local controllers 221-217 or directly of the actuators 241-248 to cause the well construction equipment to stop performing the ongoing selected planned operational sequence and start performing the selected mitigating operational sequence to mitigate the abnormal event.

The following paragraphs describe several examples of the control system 200 monitoring and controlling the well construction equipment of the well construction system 100 according to one or more aspects of the present disclosure. Accordingly, the following paragraphs refer to FIGS. 1 and 2, collectively.

During a tripping operational state of the well construction system 100, while the control process 250 is executing a planned operational sequence to trip a drill string from depth A to depth B, an equipment controller (e.g., the central controller 192, the local controller 221) receives sensor data from a sensor 145, 186, 231 indicating a sudden weight loss of the drill string. Based on such sensor data and operational state, the abnormal event detector 254 may detect that a bottom end of the drill string encountered an obstruction, such as a downhole bridge. If no immediate action is taken, serious equipment damage, such as damage to the drill bit, the BHA, and/or the drill string may occur. In a worst case, the well may get lost. When such an abnormal event is detected, the operational sequence selector 258 may select an emergency shutdown operational sequence to the control process 250 or the local control process, which causes an immediate stop of the drawworks to avoid the potential downhole failure. Thus, a bridge protection detection algorithm containing a predetermined operational sequence may be implemented directly within the equipment controller 192, 211. Accordingly, when the sensor data indicates a sudden decrease in the weight of the drill string during tripping in operational state, the one or more of the equipment controllers 192, 221-228 may be operable to: detect that the drill string contacted an obstruction within the wellbore; select a mitigating operational sequence to shutdown the drawworks; and output control data to cause the drawworks to perform the mitigating operational sequence to shut down, thereby stopping operation of the drawworks.

Furthermore, during a drilling operational state of the well construction system 100, while the control process 250 is executing a planned operational sequence to drill the wellbore from depth A to depth B, an equipment controller (e.g., the central controller 192, the local controller 222) receives sensor data from a sensor 151, 232 indicating a sudden gain of return fluid flow. Based on such sensor data and operational state, the abnormal event detector 254 may detect that the wellbore is experiencing a kick. Consequence of an uncontrollable kick can lead to environmental damage, or even a blowout. There are a number of predetermined operational sequences that can be performed depending on, for example, the severity of the kick, the well control procedure and available equipment and/or materials at the wellsite. One option to address abnormal fluid gain is to adjust drilling fluid density and to circulate out the kick. If this option is taken, the operational sequence may cause fluid management valves to automatically line up to switch to a different drilling fluid tank, or to perform on the fly a drilling fluid mixing sequence to change the drilling fluid density. Another option to address a kick can include initiating a well control sequence by first shutting-in the well and circulating the kick. Well shut-in may include a number of operational sequences, such as raising the drilling string 120, stopping the pumps 144, and activating the BOP 130, among other examples. After a well control sequence is selected by the operational sequence selector 258, the selected well control sequence may be passed to the control process 250 or the local control process and executed automatically without intervention by the rig personnel. Accordingly, when the sensor data indicates a sudden increase in the flow rate of the wellbore fluid flowing out of the wellbore during the drilling operational state, the one or more of the equipment controllers 192, 221-228 may be operable to: detect that the wellbore is experiencing a kick; select an operational sequence to change density of drilling fluid, or operate well control sequence; and output control data to cause drilling fluid mixing system to perform the operational sequence to change the density of the drilling fluid thereby stopping the wellbore kick, or cause the rig and well control equipment to perform the well control sequence, thereby stopping and removing the wellbore kick.

Furthermore, during a tripping in operational state of the well construction system 100, while the control process 250 is executing a planned operational sequence to trip in the drill string 120 from depth A to depth B of the wellbore 102 following a pre-set tripping in speed, which may be depth dependent, an equipment controller (e.g., the central controller 192, the local controller 222) receives sensor data from a sensor 151, 186, 232 indicating a sudden increase of downhole wellbore pressure. Based on such sensor data and operational state, the abnormal event detector 254 may detect that the wellbore is experiencing a surge. Downhole wellbore pressure may lead to formation fracture, leading to wellbore damage. An example of a mitigating operational sequence is to reduce the trip in speed. Thus, after a mitigating operational sequence is selected by the operational sequence selector 258, the selected mitigating operational sequence may be passed to the control process 250 or the local control process and executed automatically without intervention by rig personnel. Such predetermined mitigating operational sequences can be saved to one or more of the central and local equipment controllers 192, 221-228 to ensure the secure and efficient execution of well construction operations without intervention by the rig personnel. Accordingly, when the sensor data indicates a sudden increase in the downhole pressure of the wellbore during the tripping in operational state, the one or more of the equipment controllers 192, 221-228 may be operable to: detect that the wellbore is experiencing a wellbore surge; select an operational sequence to reduce a tripping in speed of the drawworks 118 or another mitigating operational sequence; and output control data to cause the drawworks 118 to perform the selected operational sequence, thereby stopping or reducing the surge.

Furthermore, during a tripping out operational state of the well construction system 100, while the control process 250 is executing a planned operational sequence to trip out the drill string 120 from depth B to depth A of the wellbore 102 following a pre-set tripping out speed, which may be depth dependent, an equipment controller (e.g., the central controller 192, the local controller 222) receives sensor data from a sensor 151, 186, 232 indicating a sudden decrease of downhole wellbore pressure. Based on such sensor data and operational state, the abnormal event detector 254 may detect that the wellbore is experiencing a swab. If the downhole wellbore pressure is reduced sufficiently, reservoir fluids may flow from the formation 106 into the wellbore 102 and towards the surface 104. Swabbing can lead to wellbore stability problems and kicks, which as described above, can lead to environmental damage or even a blowout. Depending on the severity of the swab, there are several mitigating operational sequences available to overcome a swab. One mitigating operational sequence is to reduce the trip out speed. After a mitigating operational sequence is selected by the operational sequence selector 258 to reduce the trip out speed, the selected mitigating operational sequence may be passed to the control process 250 or the local control process and executed automatically without intervention by rig personnel. In conjunction with slowing the trip out speed, fluid circulation may be included to fill in the well through the annulus to keep the well full or maintain the downhole pressure. However, if the adjusted trip out speed and/or fluid circulating into the annulus cannot control the swab, further action can be taken, such as to stop the trip out operations (i.e., stop the drawworks 118), and initiate well control procedure. Such predetermined mitigating operational sequences can be saved to one or more of the central and local equipment controllers 192, 221-228 to ensure the secure and efficient execution of well construction operations without intervention by the rig personnel. Accordingly, when the sensor data indicates a sudden decrease in downhole wellbore pressure during the tripping out operational state, the one or more of the equipment controllers 192, 221-228 may be operable to: detect that the wellbore is experiencing a wellbore swab; select an operational sequence to reduce a tripping out speed of the drawworks 118 and/or increase fluid circulation into the annulus or another mitigating operational sequence; and output control data to cause the drawworks 118 and the corresponding pump 144 to perform the selected operational sequence, thereby stopping or reducing the swab.

Furthermore, during an operational state that comprises drilling with the mud motor 184, a risk of downhole failure could occur in the form of motor twist-off. During the mud motor drilling operation state, an equipment controller (e.g., the central controller 192, one or more of the local controllers 221-228) receives sensor data from a sensor 186 indicating mud motor reverse rotation downhole (namely, instead of bit 126 rotating clockwise, the mud motor stator rotates counterclockwise). By using rotational speed measurements, which could be derived from magnetic and or gyroscopic measurements, mud motor reverse rotation can be detected. The downhome rotational speed sensor data and/or the occurrence of the mud motor reverse rotation can be transmitted to the surface 104 in real time. Based on such sensor data and operational state, the abnormal event detector 254 may detect that the wellbore is experiencing stick-slip or bit stalling. The sequence selector 258 may then select a mitigating operational sequence based on the detected abnormal event and the operational state, including but not limited to, reduce or stop pumping operations, reduce WOB, and/or activate stick-slip mitigation control. After a mitigating operational sequence is selected by the operational sequence selector 258, the selected mitigating operational sequence may be passed to the control process 250 or the local control process and executed automatically without intervention by the rig personnel. Accordingly, when the sensor data indicates a reverse rotation of the mud motor during mud motor drilling operational state, the one or more of the equipment controllers 192, 221-228 may be operable to: detect a stuck drill bit when the sensor data indicates reverse rotation of the mud motor; select an operational sequence to stop pumping drilling fluid, reduce weight on bit, or activate automatic drill bit rotation control; and output control data to cause a mud pump to perform the operational sequence to stop pumping the drilling fluid thereby stopping the reverse rotation of the mud motor, cause the drawworks to perform the operational sequence to reduce the weight on bit thereby stopping the reverse rotation of the mud motor, or cause the automatic drill bit rotation control to activate thereby stopping the reverse rotation of the mud motor.

Still further, when the sensor data indicates a sudden decrease in the pressure of the drilling fluid being pumped into the drill string during drilling operations, an equipment controller 192, 244 is operable to: detect that the drill string is experiencing a drilling fluid leak; select an operational sequence to reduce flow rate of the drilling fluid being pumped into the drill string, or stop the drilling operations; and output control data to cause a mud pump to perform the operational sequence to reduce the flow rate of the drilling fluid being pumped into the drill string, or cause the well construction equipment to perform the operational sequence to stop the drilling operations.

Also, when the sensor data indicates that a mud motor toolface 185 is not oriented as intended during drilling operations, the equipment controller 192, 241, 245 is operable to: select an operational sequence to rotate a top drive, change oscillation characteristics of the top drive, or change weight on bit; and output control data to cause the top drive to perform the operational sequence to rotate the top drive thereby changing the orientation of the mud motor toolface 185 to an intended mud motor toolface 185 orientation, cause the top drive to perform the operational sequence to change the oscillation characteristics of the top drive thereby changing the orientation of the mud motor toolface 185 to an intended mud motor toolface orientation, or cause a drawworks to perform the operational sequence to change the weight on bit thereby changing the orientation of the mud motor toolface 185 to an intended mud motor toolface orientation.

Figure 3:
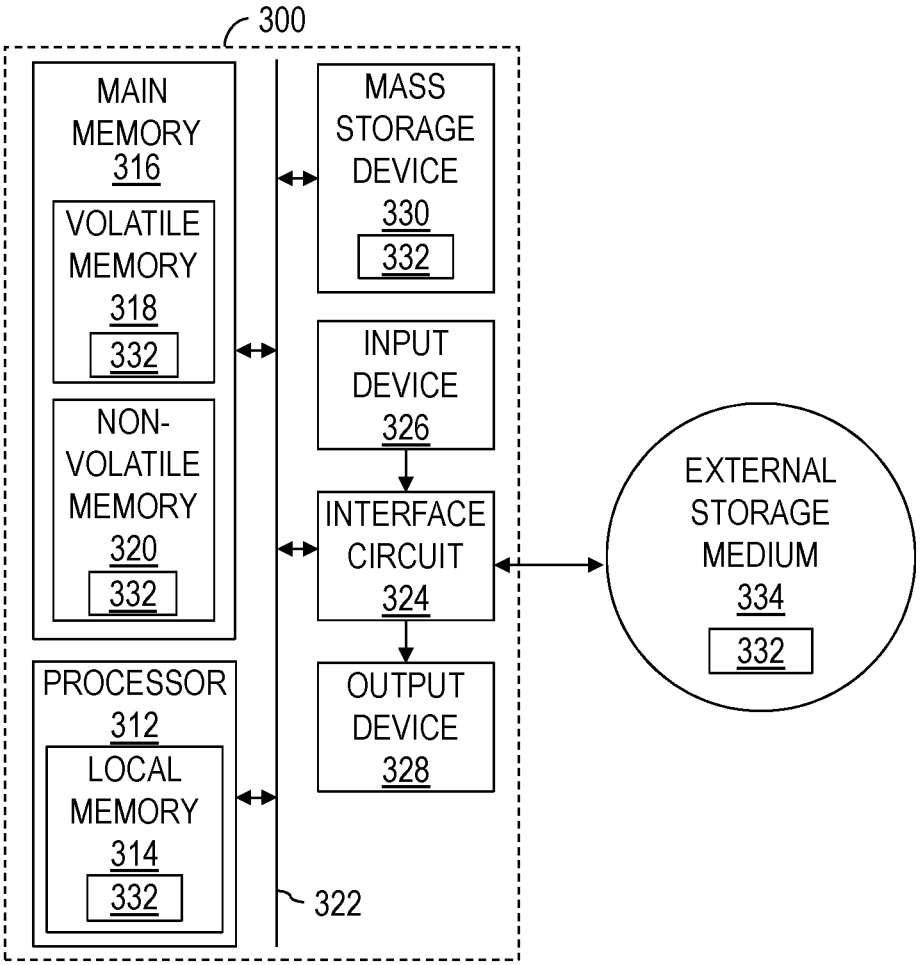
FIG. 3 is a schematic view of at least a portion of an example implementation of apparatus according to one or more aspects of the present disclosure.

FIG. 3 is a schematic view of at least a portion of an example implementation of a processing device 300 (or system) according to one or more aspects of the present disclosure. The processing device 300 may be or form at least a portion of one or more equipment controllers and/or other electronic devices shown in one or more of the FIGS. 1 and 2. Accordingly, the following description refers to FIGS. 1-3, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 300 may be or form at least a portion of the rig control system 200, including the downhole controller 188, the central controller 192, the local controllers 221-228, and the control workstation 197. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314, and may execute machine-readable and executable program code instructions 332 (i.e., computer program code) present in the local memory 314 and/or another memory device. The processor 312 may execute, among other things, the program code instructions 332 and/or other instructions and/or programs to implement the example methods and/or operations described herein. For example, the program code instructions 332, when executed by the processor 312 of the processing device 300, may cause the processor 312 to receive and process (e.g., compare) sensor data (e.g., sensor measurements) and output information indicative of accuracy the sensor data and, thus, the corresponding sensors according to one or more aspects of the present disclosure. The program code instructions 332, when executed by the processor 312 of the processing device 300, may also or instead cause one or more portions or pieces of well construction equipment of a well construction system to perform the example methods and/or operations described herein. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit rig personnel to enter the program code instructions 332, which may be or comprise control data, operational parameters, operational set-points, a well construction drill plan, and/or database of operational sequences. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit for visualization or other sensory perception of various data, such as sensor data, status data, and/or other example data. The output devices 328 may be, comprise, or be implemented by video output devices (e.g., an LCD, an LED display, a CRT display, a touchscreen, etc.), printers, and/or speakers, among other examples. The one or more input devices 326 and the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to example methods (e.g., operations, processes, actions) for monitoring and controlling well construction equipment of a well construction system according to one or more aspects of the present disclosure. The example methods may be performed utilizing or otherwise in conjunction with at least a portion of one or more implementations of one or more instances of the apparatus shown in one or more of FIGS. 1-3, and/or otherwise within the scope of the present disclosure. For example, the methods may be performed and/or caused, at least partially, by a processing device, such as the processing device 300 executing program code instructions 332 according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be performed and/or caused, at least partially, by rig personnel utilizing one or more instances of the apparatus shown in one or more of FIGS. 1-3, and/or otherwise within the scope of the present disclosure. Thus, the following description refers to apparatus shown in one or more of FIGS. 1-3 and methods that can be performed by such apparatus. However, the methods may also be performed in conjunction with implementations of apparatus other than those depicted in FIGS. 1-3 that are also within the scope of the present disclosure.

Figure 4:
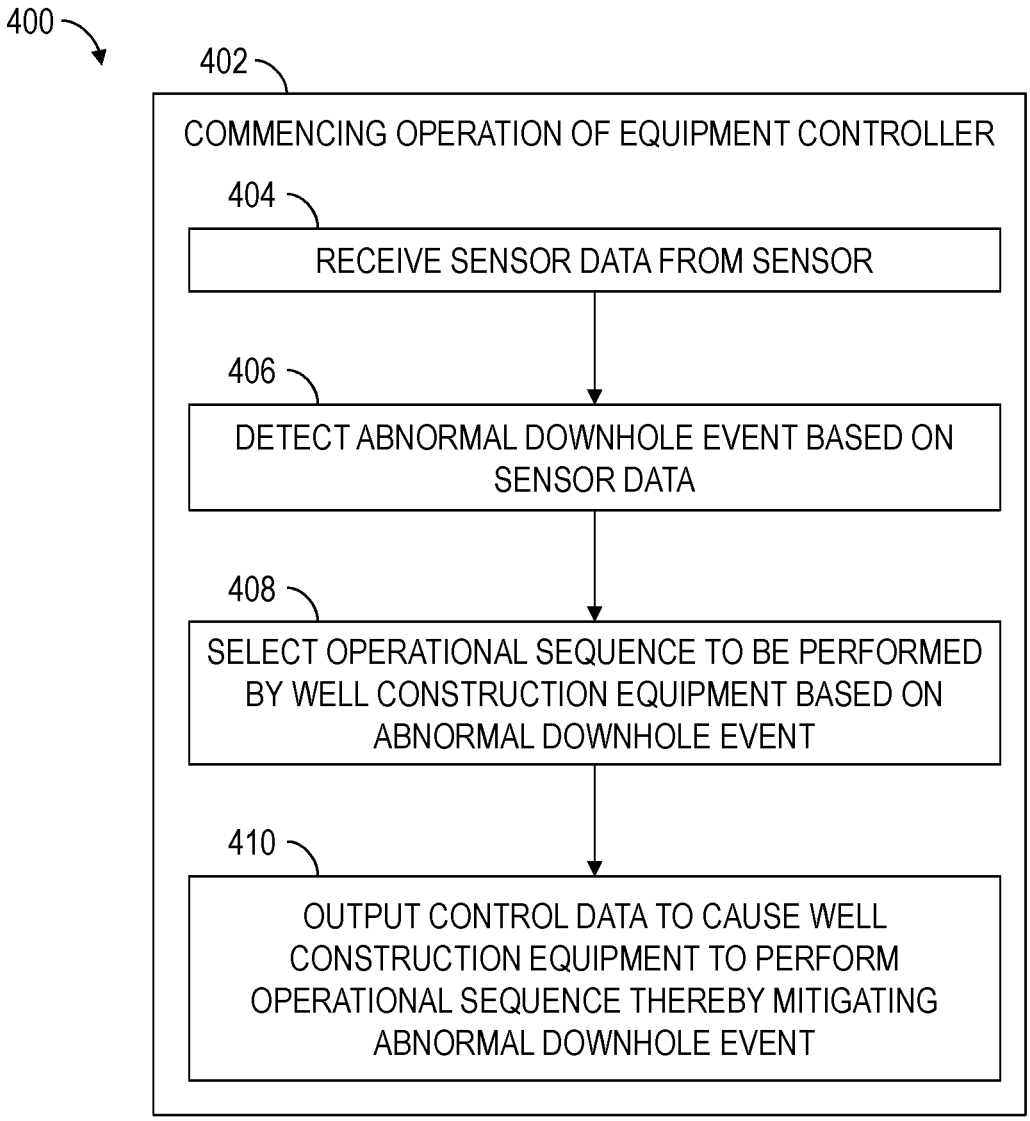
FIG. 4 is a flow-chart diagram of at least a portion of a method according to one or more aspects of the present disclosure.
Figure 5:
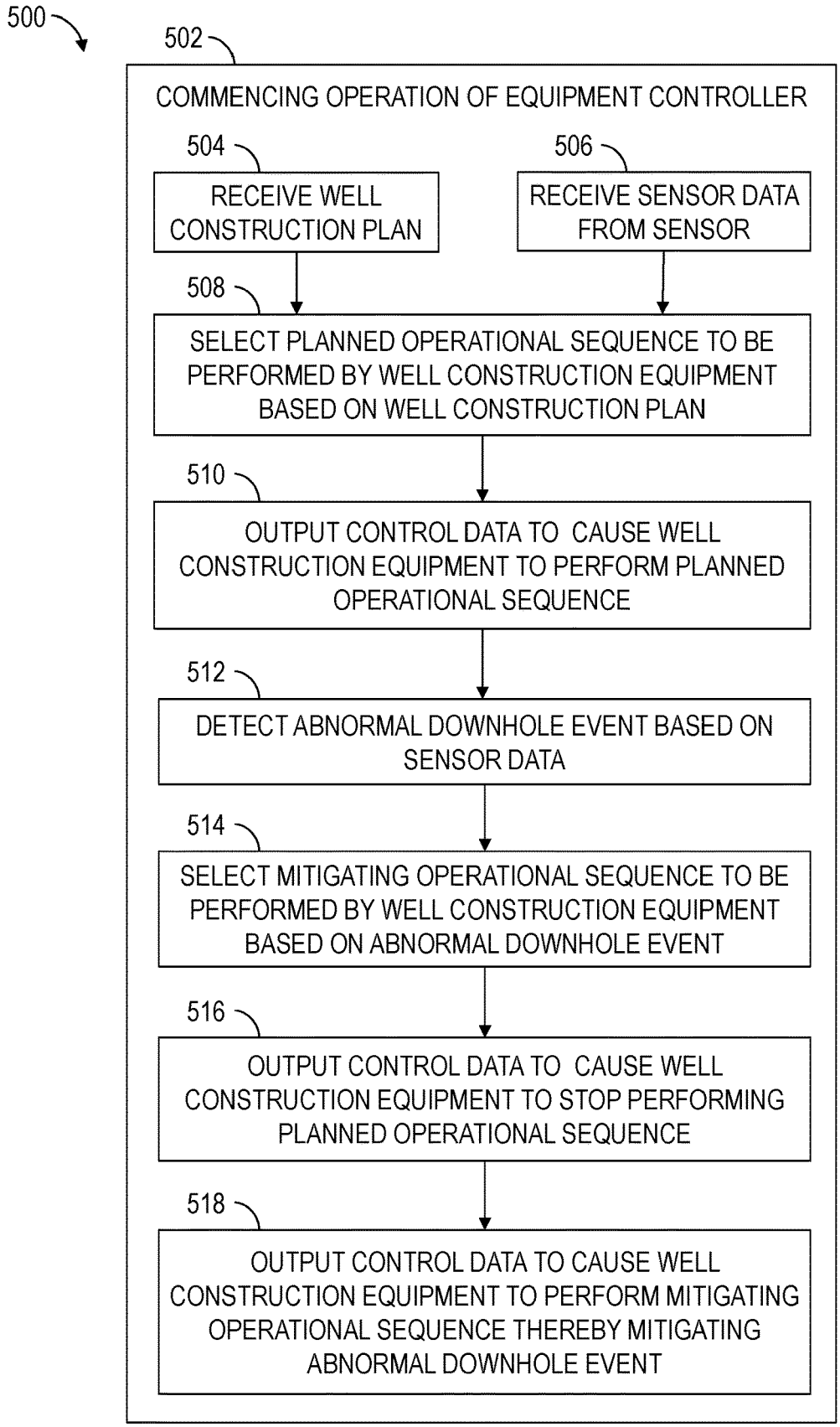
FIG. 5 is a flow-chart diagram of at least a portion of a method according to one or more aspects of the present disclosure.

FIGS. 4 and 5 are flow-chart diagrams of at least a portion of example methods (400), (500), respectively, according to one or more aspects of the present disclosure. The method (400) may comprise commencing operation (402) of an equipment controller 192, 221-228, 300 of a control system 200 for monitoring and controlling a well construction rig 100. The well construction rig 100 may comprise well construction equipment operable to perform well construction operations. Commencing operation (402) of the equipment controller 192, 221-228, 300 may cause the equipment controller 192, 221-228, 300 to: receive (404) sensor data from a sensor 186, 231-238; detect (406) an abnormal downhole event based on the sensor data; select (408) an operational sequence to be performed by the well construction equipment based on the abnormal downhole event; and output (410) control data to cause the well construction equipment to perform the operational sequence thereby mitigating the abnormal downhole event.

The method (500) may comprise commencing operation (502) of an equipment controller 192, 221-228, 300 of a control system 200 for monitoring and controlling a well construction rig 100. The well construction rig 100 may comprise well construction equipment operable to perform well construction operations. Commencing operation (502) of the equipment controller 192, 221-228, 300 may cause the equipment controller 192, 221-228, 300 to: receive (504) a well construction plan; receive (506) sensor data from a sensor 186, 231-238; select (508) a planned operational sequence to be performed by the well construction equipment based on the well construction plan; output (510) control data to cause the well construction equipment to perform the planned operational sequence; detect (512) an abnormal downhole event based on the sensor data; and after detecting (512) the abnormal downhole event: select (514) a mitigating operational sequence to be performed by the well construction equipment based on the abnormal downhole event; output (516) control data to cause the well construction equipment to stop performing the planned operational sequence; and output (518) control data to cause the well construction equipment to perform the mitigating operational sequence thereby mitigating the abnormal downhole event.

In view of the entirety of the present disclosure, including the figures and the claims, a person having ordinary skill in the art will readily recognize that the present disclosure introduces an apparatus comprising a control system of a well construction system, wherein the well construction system comprises well construction equipment operable to perform well construction operations, and wherein the control system comprises: (A) a sensor operable to output sensor data; and (B) an equipment controller communicatively connected with the sensor and the well construction equipment, wherein the equipment controller comprises a processing device and a memory storing an executable program code, and wherein during the well construction operations the equipment controller is operable to: (i) receive the sensor data; (ii) detect an abnormal downhole event based on the sensor data; (iii) select an operational sequence to be performed by the well construction equipment based on the abnormal downhole event; and (iv) output control data to cause the well construction equipment to perform the selected operational sequence thereby mitigating the abnormal downhole event.

The well construction equipment may comprise at least one of: a mud pump operable to pump drilling fluid; a drawworks operable to lift a drill string; a top drive operable to rotate a drill string; a rotary table operable to rotate a drill string; and a mud motor operable to rotate a drill bit.

The sensor data may comprise at least one of: weight data indicative of weight of a drill string and speed data indicative of speed of a drawworks; torque data indicative of torque output by a top drive and speed data indicative of speed of the top drive; and pressure data indicative of pressure generated by a mud pump and flow rate data indicative of flow rate generated by the mud pump.

The abnormal downhole event may comprise at least one of an abnormal operational condition of a drill string and an abnormal condition of a downhole fluid. The abnormal operational condition of the drill string may comprise at least one of stick slip, axial vibrations, lateral vibrations, rotational vibrations, a downhole obstruction, and stuck drill pipe, and the abnormal condition of the downhole fluid may comprise at least one of swab, surge, gains of wellbore fluid, and losses of wellbore fluid.

When the sensor data indicates a sudden decrease in weight of a drill string during tripping in operations, the equipment controller may be operable to: detect that the drill string contacted an obstruction within a wellbore; select an operational sequence to decrease speed of or stop a drawworks; and output control data to cause the drawworks to perform the operational sequence to stop operation of the drawworks.

When the sensor data indicates during well drilling operations a sudden increase in flow rate of wellbore fluid flowing out of a wellbore and/or a sudden increase in downhole pressure of the wellbore fluid, the equipment controller may be operable to: (A) detect that the wellbore is experiencing a kick; (B) select an operational sequence to: (i) change density of drilling fluid; and/or (ii) operate well control equipment; and (C) output control data to: (i) cause drilling fluid mixing system to perform the operational sequence to change the density of the drilling fluid thereby stopping the wellbore kick; and/or (ii) cause the well control equipment to perform the operational sequence to operate the well control equipment thereby mitigating the wellbore kick.

When the sensor data indicates during tripping in operations a sudden increase in flow rate of wellbore fluid flowing out of a wellbore and/or a sudden increase in downhole pressure of the wellbore fluid, the equipment controller may be operable to: detect that the wellbore is experiencing a surge; select an operational sequence to reduce tripping in speed of a drawworks; and output control data to cause the drawworks to perform the operational sequence to reduce the tripping in speed thereby mitigating the wellbore surge.

When the sensor data indicates a sudden decrease in the downhole pressure of the wellbore during tripping out operations, the equipment controller may be operable to: detect that the wellbore is experiencing a swab; select an operational sequence to reduce tripping out speed of a drawworks; and output control data to cause the drawworks to perform the operational sequence to reduce the tripping out speed thereby mitigating the wellbore swab.

When the sensor data indicates reverse rotation of a mud motor during drilling operations, the equipment controller may be operable to: (A) detect a stuck drill bit; (B) select an operational sequence to: (i) stop pumping drilling fluid; (ii) reduce weight on bit; and/or (iii) activate automatic drill bit rotation control; and (C) output control data to: (i) cause a mud pump to perform the operational sequence to stop pumping the drilling fluid thereby mitigating the reverse rotation of the mud motor; (ii) cause a drawworks to perform the operational sequence to reduce weight on bit thereby mitigating the reverse rotation of the mud motor; and/or (iii) cause the automatic drill bit rotation control to activate thereby mitigating the reverse rotation of the mud motor.

When the sensor data indicates a sudden decrease in pressure of drilling fluid being pumped into a drill string during drilling operations, the equipment controller may be operable to: (A) detect that the drill string is experiencing a drilling fluid leak; (B) select an operational sequence to: (i) reduce flow rate of the drilling fluid being pumped into the drill string; and/or (ii) stop the drilling operations; and (C) output control data to: (i) cause a mud pump to perform the operational sequence to reduce the flow rate of the drilling fluid being pumped into the drill string; and/or (ii) cause the well construction equipment to perform the operational sequence to stop the drilling operations.

When the sensor data indicates that a mud motor toolface is not oriented as intended during drilling operations, the equipment controller may be operable to: (A) select an operational sequence to: (i) rotate a top drive; (ii) change oscillation characteristics of the top drive; and/or (iii) change weight on bit; and (B) output control data to: (i) cause the top drive to perform the operational sequence to rotate the top drive thereby changing orientation of the mud motor toolface to an intended orientation of the mud motor toolface; (ii) cause the top drive to perform the operational sequence to change the oscillation characteristics of the top drive thereby changing orientation of the mud motor toolface to an intended orientation of the mud motor toolface; and/or (iii) cause a drawworks to perform the operational sequence to change the weight on bit thereby changing orientation of the mud motor toolface to an intended orientation of the mud motor toolface.

The memory may be operable to store a database of operational sequences, and the equipment controller may be operable to select from the database the operational sequence to be performed by the well construction equipment based on the abnormal downhole event.

The memory may be operable to store a well construction plan for constructing a well, and the equipment controller may be operable to select the operational sequence to be performed by the well construction equipment further based on the stored well construction plan. The well construction plan may comprise at least one of: a planned path along which the well is to be drilled through rock formation; a planned depth of the well; and operational parameters at which the well construction equipment is to be operated during the well construction operations.

The operational sequence may be a mitigating operational sequence, and during the well construction operations the equipment controller may be further operable to: (A) receive a well construction plan; (B) before detecting the abnormal downhole event: (i) select a planned operational sequence to be performed by the well construction equipment based on the well construction plan; and (ii) output control data to cause the well construction equipment to perform the planned operational sequence; and (C) after detecting the abnormal downhole event, output control data to cause the well construction equipment to stop performing the planned operational sequence. The selected planned operational sequence may comprise an operational sequence for drilling a selected portion of the well.

The present disclosure also introduces a method comprising commencing operation of an equipment controller of a control system for monitoring and controlling a well construction system, wherein the well construction system comprises well construction equipment operable to perform well construction operations, and wherein commencing operation of the equipment controller causes the equipment controller to: receive sensor data from a sensor; detect an abnormal downhole event based on the sensor data; select an operational sequence to be performed by the well construction equipment based on the abnormal downhole event; and output control data to cause the well construction equipment to perform the operational sequence thereby mitigating the abnormal downhole event.

The well construction equipment may comprise at least one of: a mud pump operable to pump drilling fluid; a drawworks operable to lift a drill string; a top drive operable to rotate the drill string; a rotary table operable to rotate the drill string; and a mud motor operable to rotate a drill bit.

The sensor data may comprise at least one of: weight data indicative of weight of a drill string and speed data indicative of speed of a drawworks; torque data indicative of torque output by a top drive and speed data indicative of speed of the top drive; and pressure data indicative of pressure generated by a mud pump and flow rate data indicative of flow rate generated by the mud pump.

The abnormal downhole event may comprise at least one of an abnormal operational condition of a drill string and an abnormal condition of a downhole fluid. The abnormal operational condition of the drill string may comprise at least one of stick slip, axial vibrations, lateral vibrations, rotational vibrations, a downhole obstruction, and stuck drill pipe, and the abnormal condition of the downhole fluid may comprise at least one of swab, surge, gains of wellbore fluid, and losses of wellbore fluid.

When the sensor data indicates a sudden decrease in weight of a drill string during tripping in operations, commencing operation of the equipment controller may cause the equipment controller to: detect that the drill string contacted an obstruction within a wellbore; select the operational sequence to decrease speed of or stop a drawworks; and output the control data to cause the drawworks to perform the operational sequence to stop operation of the drawworks.

When the sensor data indicates during well drilling operations a sudden increase in flow rate of wellbore fluid flowing out of a wellbore and/or a sudden increase in downhole pressure of the wellbore fluid, commencing operation of the equipment controller may cause the equipment controller to: (A) detect that the wellbore is experiencing a kick; (B) select the operational sequence to: (i) change density of drilling fluid; and/or (ii) operate well control equipment; and (C) output the control data to: (i) cause drilling fluid mixing system to perform the operational sequence to change the density of the drilling fluid thereby stopping the wellbore kick; and/or (ii) cause the well control equipment to perform the operational sequence to operate the well control equipment thereby mitigating the wellbore kick.

When the sensor data indicates during tripping in operations a sudden increase in flow rate of wellbore fluid flowing out of a wellbore and/or a sudden increase in downhole pressure of the wellbore fluid, commencing operation of the equipment controller may cause the equipment controller to: detect that the wellbore is experiencing a surge; select the operational sequence to reduce tripping in speed of a drawworks; and output the control data to cause the drawworks to perform the operational sequence to reduce the tripping in speed thereby mitigating the wellbore surge.

When the sensor data indicates a sudden decrease in the downhole pressure of the wellbore during tripping out operations, commencing operation of the equipment controller may cause the equipment controller to: detect that the wellbore is experiencing a swab; select the operational sequence to reduce tripping out speed of a drawworks; and output the control data to cause the drawworks to perform the operational sequence to reduce the tripping out speed thereby mitigating the wellbore swab.

When the sensor data indicates reverse rotation of a mud motor during drilling operations, commencing operation of the equipment controller may cause the equipment controller to: (A) detect a stuck drill bit; (B) select the operational sequence to: (i) stop pumping drilling fluid; (ii) reduce weight on bit; and/or (iii) activate automatic drill bit rotation control; and (C) output the control data to: (i) cause a mud pump to perform the operational sequence to stop pumping the drilling fluid thereby mitigating the reverse rotation of the mud motor; (ii) cause a drawworks to perform the operational sequence to reduce weight on bit thereby mitigating the reverse rotation of the mud motor; and/or (iii) cause the automatic drill bit rotation control to activate thereby mitigating the reverse rotation of the mud motor.

When the sensor data indicates a sudden decrease in pressure of drilling fluid being pumped into a drill string during drilling operations, commencing operation of the equipment controller may cause the equipment controller to: (A) detect that the drill string is experiencing a drilling fluid leak; (B) select the operational sequence to: (i) reduce flow rate of the drilling fluid being pumped into the drill string; and/or (ii) stop the drilling operations; and (C) output the control data to: (i) cause a mud pump to perform the operational sequence to reduce the flow rate of the drilling fluid being pumped into the drill string; and/or (ii) cause the well construction equipment to perform the operational sequence to stop the drilling operations.

When the sensor data indicates that a mud motor toolface is not oriented as intended during drilling operations, commencing operation of the equipment controller may cause the equipment controller to: (A) select the operational sequence to: (i) rotate a top drive; (ii) change oscillation characteristics of the top drive; and/or (iii) change weight on bit; and (B) output the control data to: (i) cause the top drive to perform the operational sequence to rotate the top drive thereby changing orientation of the mud motor toolface to an intended orientation of the mud motor toolface; (ii) cause the top drive to perform the operational sequence to change the oscillation characteristics of the top drive thereby changing orientation of the mud motor toolface to an intended orientation of the mud motor toolface; and/or (iii) cause a drawworks to perform the operational sequence to change the weight on bit thereby changing orientation of the mud motor toolface to an intended orientation of the mud motor toolface.

The method may further comprise storing a database of operational sequences to a memory, wherein commencing operation of the equipment controller may cause the equipment controller to select from the database the operational sequence to be performed by the well construction equipment based on the abnormal downhole event.

The method may further comprise storing a well construction plan for constructing a well to a memory, wherein commencing operation of the equipment controller may cause the equipment controller to select the operational sequence to be performed by the well construction equipment further based on the stored well construction plan. The well construction plan may comprise at least one of: a planned path along which the well is to be drilled through rock formation; a planned depth of the well; and operational parameters at which the well construction equipment is to be operated during the well construction operations.

The operational sequence may be a mitigating operational sequence, and commencing operation of the equipment controller may further cause the equipment controller to: (A) receive a well construction plan; (B) before detecting the abnormal downhole event: (i) select a planned operational sequence to be performed by the well construction equipment based on the well construction plan; and (ii) output control data to cause the well construction equipment to perform the planned operational sequence; and (C) after detecting the abnormal downhole event, output control data to cause the well construction equipment to stop performing the planned operational sequence. The selected planned operational sequence may comprise an operational sequence for drilling a selected portion of the well.

The present disclosure also introduces a method comprising commencing operation of an equipment controller of a control system for monitoring and controlling a well construction system, wherein the well construction system comprises well construction equipment operable to perform well construction operations, and wherein commencing operation of the equipment controller causes the equipment controller to: (A) receive a well construction plan; (B) receive sensor data from a sensor; (C) select a planned operational sequence to be performed by the well construction equipment based on the well construction plan; (D) output control data to cause the well construction equipment to perform the planned operational sequence; (E) detect an abnormal downhole event based on the sensor data; and (F) after detecting the abnormal downhole event: (i) select a mitigating operational sequence to be performed by the well construction equipment based on the abnormal downhole event; (ii) output control data to cause the well construction equipment to stop performing the planned operational sequence; and (iii) output control data to cause the well construction equipment to perform the mitigating operational sequence thereby mitigating the abnormal downhole event.

The well construction equipment may comprise at least one of: a mud pump operable to pump drilling fluid; a drawworks operable to lift a drill string; a top drive operable to rotate a drill string; a rotary table operable to rotate a drill string; and a mud motor operable to rotate a drill bit.

The sensor data may comprise at least one of: weight data indicative of weight of a drill string and speed data indicative of speed of a drawworks; torque data indicative of torque output by a top drive and speed data indicative of speed of the top drive; and pressure data indicative of pressure generated by a mud pump and flow rate data indicative of flow rate generated by the mud pump.

The abnormal downhole event may comprise at least one of an abnormal operational condition of a drill string and an abnormal condition of a downhole fluid. The abnormal operational condition of the drill string may comprise at least one of stick slip, axial vibrations, lateral vibrations, rotational vibrations, a downhole obstruction, and stuck drill pipe, and the abnormal condition of the downhole fluid may comprise at least one of swab, surge, gains of wellbore fluid, and losses of wellbore fluid.

When the sensor data indicates a sudden decrease in weight of a drill string during tripping in operations, commencing operation of the equipment controller may cause the equipment controller to: detect that the drill string contacted an obstruction within a wellbore; select the mitigating operational sequence to decrease speed of or stop a drawworks; and output the control data to cause the drawworks to perform the mitigating operational sequence to stop operation of the drawworks.

When the sensor data indicates during well drilling operations a sudden increase in flow rate of wellbore fluid flowing out of a wellbore and/or a sudden increase in downhole pressure of the wellbore fluid, commencing operation of the equipment controller may cause the equipment controller to: (A) detect that the wellbore is experiencing a kick; (B) select the mitigating operational sequence to: (i) change density of drilling fluid; and/or (ii) operate well control equipment; and (C) output control data to: (i) cause drilling fluid mixing system to perform the mitigating operational sequence to change the density of the drilling fluid thereby stopping the wellbore kick; and/or (ii) cause the well control equipment to perform the mitigating operational sequence to operate the well control equipment thereby mitigating the wellbore kick.

When the sensor data indicates during tripping in operations a sudden increase in flow rate of wellbore fluid flowing out of a wellbore and/or a sudden increase in downhole pressure of the wellbore fluid, commencing operation of the equipment controller may cause the equipment controller to: detect that the wellbore is experiencing a surge; select the mitigating operational sequence to reduce tripping in speed of a drawworks; and output control data to cause the drawworks to perform the mitigating operational sequence to reduce the tripping in speed thereby mitigating the wellbore surge.

When the sensor data indicates a sudden decrease in the downhole pressure of the wellbore during tripping out operations, commencing operation of the equipment controller may cause the equipment controller to: detect that the wellbore is experiencing a swab; select the mitigating operational sequence to reduce tripping out speed of a drawworks; and output control data to cause the drawworks to perform the mitigating operational sequence to reduce the tripping out speed thereby mitigating the wellbore swab.

When the sensor data indicates reverse rotation of a mud motor during drilling operations, commencing operation of the equipment controller may cause the equipment controller to: (A) detect a stuck drill bit; (B) select the mitigating operational sequence to: (i) stop pumping drilling fluid; (ii) reduce weight on bit; and/or (iii) activate automatic drill bit rotation control; and (C) output control data to: (i) cause a mud pump to perform the mitigating operational sequence to stop pumping the drilling fluid thereby mitigating the reverse rotation of the mud motor; (ii) cause a drawworks to perform the mitigating operational sequence to reduce weight on bit thereby mitigating the reverse rotation of the mud motor; and/or (iii) cause the automatic drill bit rotation control to activate thereby mitigating the reverse rotation of the mud motor.

When the sensor data indicates a sudden decrease in pressure of drilling fluid being pumped into a drill string during drilling operations, commencing operation of the equipment controller may cause the equipment controller to: (A) detect that the drill string is experiencing a drilling fluid leak; (B) select the mitigating operational sequence to: (i) reduce flow rate of the drilling fluid being pumped into the drill string; and/or (ii) stop the drilling operations; and (C) output control data to: (i) cause a mud pump to perform the mitigating operational sequence to reduce the flow rate of the drilling fluid being pumped into the drill string; and/or (ii) cause the well construction equipment to perform the mitigating operational sequence to stop the drilling operations.

When the sensor data indicates that a mud motor toolface is not oriented as intended during drilling operations, commencing operation of the equipment controller may cause the equipment controller to: (A) select the mitigating operational sequence to: (i) rotate a top drive; (ii) change oscillation characteristics of the top drive; and/or (iii) change weight on bit; and (B) output control data to: (i) cause the top drive to perform the mitigating operational sequence to rotate the top drive thereby changing orientation of the mud motor toolface to an intended orientation of the mud motor toolface; (ii) cause the top drive to perform the mitigating operational sequence to change the oscillation characteristics of the top drive thereby changing orientation of the mud motor toolface to an intended orientation of the mud motor toolface; and/or (iii) cause a drawworks to perform the mitigating operational sequence to change the weight on bit thereby changing orientation of the mud motor toolface to an intended orientation of the mud motor toolface.

The method may further comprise storing a database of mitigating operational sequences to a memory, wherein commencing operation of the equipment controller may cause the equipment controller to select from the database the mitigating operational sequence to be performed by the well construction equipment based on the abnormal downhole event.

Commencing operation of the equipment controller may cause the equipment controller to select the mitigating operational sequence to be performed by the well construction equipment further based on the received well construction plan. The well construction plan may comprise at least one of: a planned path along which the well is to be drilled through rock formation; a planned depth of the well; and operational parameters at which the well construction equipment is to be operated during the well construction operations.

The selected planned operational sequence may comprise an operational sequence for drilling a selected portion of the well.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A method comprising:

commencing operation of an equipment controller of a control system for monitoring and controlling a well construction system, wherein the well construction system comprises well construction equipment operable to perform well construction operations, and wherein commencing operation of the equipment controller causes the equipment controller to:

receive sensor data from a downhole rotational speed sensor of a drill string that comprises a mud-motor operatively coupled to a bit, wherein the downhole rotational speed sensor acquires magnetic and/or gyroscopic measurements;

detect an abnormal downhole event based on the sensor data, wherein the abnormal downhole event is a stick-slip event or a bit stalling event, and wherein the sensor data indicate reverse rotation of the mud-motor as associated with a risk of mud-motor twist-off;

responsive to detection of the abnormal downhole event, automatically access a database to automatically select an operational sequence to be performed by the well construction equipment based on the abnormal downhole event, wherein the database comprises operational sequences for different types of events; and output control data to cause the well construction equipment to perform the operational sequence, wherein the operational sequence calls for a draw-works of the well construction equipment to reduce weight on the bit to thereby stop the reverse rotation of the mud motor and mitigate the risk of the mud-motor twist-off.

2. The method of claim 1 wherein commencing operation of the equipment controller further causes the equipment controller to:

receive a well construction plan;

before detecting the abnormal downhole event:

select a planned operational sequence to be performed by the well construction equipment based on the well construction plan; and output first control data to cause the well construction equipment to perform the planned operational sequence; and after detecting the abnormal downhole event, output second control data to cause the well construction equipment to stop performing the planned operational sequence.

3. The method of claim 1 wherein commencing operation of the equipment controller causes the equipment controller to detect one or more additional abnormal downhole events.

4. The method of claim 3, wherein the one or more additional abnormal downhole events comprises an abnormal condition of a downhole fluid.

5. The method of claim 4, wherein the abnormal condition of the downhole fluid comprises one or more of swab, surge, gains of wellbore fluid, and losses of wellbore fluid.

6. The method of claim 1, wherein the operational sequence additionally calls for stopping of pumping of drilling fluid.

7. A system comprising:

an equipment controller for monitoring and controlling a well construction system, wherein the well construction system comprises well construction equipment operable to perform well construction operations, and wherein the equipment controller comprises one or more processors, memory accessibly to at least one of the one or more processors, and processor-executable instructions stored in the memory that are executable to cause the equipment controller to:

receive sensor data from a downhole rotational speed sensor of a drill string that comprises a mud-motor operatively coupled to a bit, wherein the downhole rotational speed sensor acquires magnetic and/or gyroscopic measurements;

detect an abnormal downhole event based on the sensor data, wherein the abnormal downhole event is a stick-slip event or a bit stalling event, and wherein the sensor data indicate reverse rotation of the mud-motor as associated with a risk of mud-motor twist-off;

responsive to detection of the abnormal downhole event, automatically access a database to automatically select an operational sequence to be performed by the well construction equipment based on the abnormal downhole event, wherein the database comprises operational sequences for different types of events; and output control data to cause the well construction equipment to perform the operational sequence, wherein the operational sequence calls for a draw-works of the well construction equipment to reduce weight on the bit to thereby stop the reverse rotation of the mud motor and mitigate the risk of the mud-motor twist-off.

8. The system of claim 7 wherein the processor-executable instructions stored in the memory are executable to cause the equipment controller to:

receive a well construction plan;

before detection of the abnormal downhole event:

select a planned operational sequence to be performed by the well construction equipment based on the well construction plan; and output first control data to cause the well construction equipment to perform the planned operational sequence; and after detection of the abnormal downhole event, output second control data to cause the well construction equipment to stop performing the planned operational sequence.

9. The system of claim 7 wherein the processor-executable instructions stored in the memory are executable to cause the equipment controller to detect one or more additional abnormal downhole events.

10. The system of claim 9, wherein the one or more additional abnormal downhole events comprises an abnormal condition of a downhole fluid.

11. The system of claim 10, wherein the abnormal condition of the downhole fluid comprises one or more of swab, surge, gains of wellbore fluid, and losses of wellbore fluid.

12. The system of claim 7, wherein the operational sequence additionally calls for stopping of pumping of drilling fluid.

13. One or more non-transitory computer-readable storage media comprising processor-executable instructions to instruct an equipment controller of a control system to:

commence operation of the equipment controller of the control system for monitoring and controlling a well construction system, wherein the well construction system comprises well construction equipment operable to perform well construction operations;

receive sensor data from a downhole rotational speed sensor of a drill string that comprises a mud-motor operatively coupled to a bit, wherein the downhole rotational speed sensor acquires magnetic and/or gyroscopic measurements;

detect an abnormal downhole event based on the sensor data, wherein the abnormal downhole event is a stick-slip event or a bit stalling event, and wherein the sensor data indicate reverse rotation of the mud-motor as associated with a risk of mud-motor twist-off;

responsive to detection of the abnormal downhole event, automatically access a database to automatically select an operational sequence to be performed by the well construction equipment based on the abnormal downhole event, wherein the database comprises operational sequences for different types of events; and output control data to cause the well construction equipment to perform the operational sequence, wherein the operational sequence calls for a drawworks of the well construction equipment to reduce weight on the bit to thereby stop the reverse rotation of the mud motor and mitigate the risk of the mud-motor twist-off.

14. The one or more non-transitory computer-readable media of claim 13, wherein the processor-executable instructions comprise processor-executable instructions to instruct the equipment controller of the control system to:

receive a well construction plan;

before detection of the abnormal downhole event:

select a planned operational sequence to be performed by the well construction equipment based on the well construction plan; and output first control data to cause the well construction equipment to perform the planned operational sequence; and after detection of the abnormal downhole event, output second control data to cause the well construction equipment to stop performing the planned operational sequence.

15. The one or more non-transitory computer-readable media of claim 13, wherein the processor-executable instructions comprise processor-executable instructions to instruct the equipment controller of the control system to:

cause the equipment controller to detect one or more additional abnormal downhole events.

16. The one or more non-transitory computer-readable media of claim 15, wherein the one or more additional abnormal downhole events comprises an abnormal condition of a downhole fluid.

17. The one or more non-transitory computer-readable media of claim 16, wherein the abnormal condition of the downhole fluid comprises one or more of swab, surge, gains of wellbore fluid, and losses of wellbore fluid.

18. The one or more non-transitory computer-readable media of claim 13, wherein the operational sequence additionally calls for stopping of pumping of drilling fluid.

* * * * *